United States Patent [19]

Mizuno

[11] 4,376,427

[45] Mar. 15, 1983

[54] ENGINE AIR/FUEL RATIO CONTROL SYSTEM WITH BOTH NORMAL IDLING AND IDLE UP IDLING CAPABILITY

[75] Inventor: Kisaburo Mizuno, Aichi, Japan

[73] Assignee: Toyota Jidosha Kogyo Kabushiki Kaisha, Aichi, Japan

[21] Appl. No.: 321,191

[22] Filed: Nov. 13, 1981

[30] Foreign Application Priority Data

Nov. 20, 1980 [JP] Japan ..... 55-164277

[51] Int. Cl.[3] ..... F02D 33/00

[52] U.S. Cl. ..... 123/339; 60/290; 60/293; 123/344; 123/589

[58] Field of Search ..... 123/339, 341, 585, 589, 123/344; 60/290, 293

[56] References Cited

U.S. PATENT DOCUMENTS

| | | | |
|---|---|---|---|
| 3,906,723 | 9/1975 | Matumoto et al. | 60/290 |
| 4,087,965 | 5/1978 | Thornburgh | 60/290 |
| 4,165,611 | 8/1979 | Ishikawa | 60/293 |
| 4,192,140 | 3/1980 | Yamashita et al. | 123/589 |

*Primary Examiner*—William A. Cuchlinski, Jr.
*Attorney, Agent, or Firm*—Stevens, Davis, Miller & Mosher

[57] ABSTRACT

An engine includes a three way catalytic converter in its exhaust system, and a carburetor whose throttle valve has a normal and an idle up idling position, selected between by an idle up device. A device for weakening the air/fuel ratio of the mixture in the engine intake system only functions when no oxygen is detected in the engine exhaust system by an oxygen sensor. A means for supplying enough secondary air into the exhaust system upstream of the oxygen sensor to make the exhaust gases leaner than stoichiometric functions according to supply of a controlling vacuum. A first vacuum take out port is provided in the throat of the carburetor at a position downstream of the throttle valve when it is in the normal idling position and upstream of it when it is opened a little from the normal idling position. A second vacuum take out port is provided in the throat at a position downstream of the throttle valve when it is in the idle up idling position and upstream of it when it is opened a little from the idle up idling position. A vacuum switching system supplies vacuum from either the first or second take out port to the secondary air supplying means as controlling vacuum, according as idle up is being not performed, or is being performed, respectively.

13 Claims, 4 Drawing Figures

ENGINE AIR/FUEL RATIO CONTROL SYSTEM WITH BOTH NORMAL IDLING AND IDLE UP IDLING CAPABILITY

BACKGROUND OF THE INVENTION

The present invention relates to the field of air/fuel ratio control devices for internal combustion engines such as those used for automotive vehicles, and more particularly relates to the field of such air/fuel ratio control devices for engines which are equipped with carburetors in their intake systems and three way catalytic converters in their exhaust systems.

Three way catalytic converters for internal combustion engines are per se well known in various different forms. Such a three way catalytic converter is capable of converting HC, CO, and other products of incomplete combustion in the hot exhaust gases of the internal combustion engine into harmless end products by an oxidizing reaction, and also of simultaneously converting nitrogen oxides (so called NOx) in the exhaust gases into harmless end products by a reducing reaction, provided that the air/fuel ratio of the exhaust gases passing into said catalytic converter is maintained within a rather narrow range about the stoichiometric condition. If, however, the air/fuel ratio of the exhaust gases passing into said catalytic converter wanders towards the lean side stoichiometric, then although the above detailed oxidizing reaction for converting HC, CO, and other products of imcomplete combustion in the hot exhaust gases of the internal combustion engine into harmless end products continues, the reducing reaction for converting nitrogen oxides in the exhaust gases into harmless end products will substantially cease; and, if the air/fuel ratio of the exhaust gases passing into said catalytic converter wanders towards the rich side of stoichiometric, then although the reducing reaction for converting nitrogen oxides in the exhaust gases of the internal combustion engine into harmless end products continues, the oxidizing reaction for converting HC, CO, and other products of incomplete combustion in the hot exhaust gases into harmless end products will substantially cease.

It is possible to control the air/fuel ratio of the exhaust gases passing into the three way catalytic converter within a narrow range about the stoichiometric condition by controlling the air/fuel ratio of the air-fuel mixture being supplied to the internal combustion engine through its intake system within a narrow range about the stoichiometric condition, and therefore conventionally many different sorts of fuel/air ratio control systems have heretofore been proposed which have as their goal maintaining the air/fuel ratio of the air-fuel mixture being supplied to the internal combustion engine close to the stoichiometric condition.

A typical such prior art system has an oxygen sensor fitted to the exhaust manifold of the internal combustion engine, upstream of the three way catalytic converter, so as to sense the presence of oxygen in the exhaust gases therein. The signal from this oxygen sensor is then sent to a device which provides extra air into the intake system of the engine. In this case, the basic air/fuel ratio of the air-fuel mixture provided by the carburetor of the internal combustion engine is set to be rather on the rich side of stoichiometric, and thus by addition of a proper amount of extra air to the intake system the air/fuel ratio of the air-fuel mixture provided to the internal combustion engine may be controlled to be substantially the stoichiometric air/fuel ratio. Conventionally, the extra air can either be added directly into the intake manifold of the engine, downstream of the carburetor; or can be provided into a passage of the carburetor, as an additional amount of bleed air to be mixed with the fuel being provided by the carburetor, in a per se well known fashion. In either case, by feedback control performed by the extra air control device based upon the signal from the oxygen sensor, the air/fuel ratio of the air-fuel mixture provided into the cylinders of the internal combustion engine can be satisfactorily controlled to be substantially the stoichiometric air/fuel ratio, and thereby the air/fuel ratio of the exhaust gases passing into the three way catalytic converter can be satisfactorily maintained within a narrow range about the stoichiometric condition.

This kind of prior art feedback system is effective, and presents no problems for drivability of the vehicle incorporating the internal combustion engine under the engine load condition; but it is not satisfactory for engine idling operation. In fact, such a feedback system as outlined above causes surging and stumbling of the internal combustion engine to occur during idling, and stable idling operation becomes quite impossible.

In the prior art, a system that has been employed to overcome this problem has been developed as follows. Based upon the realization that during idling operation the production of nitrogen oxides by the internal combustion engine is not very considerable, and as a practical matter only the production of HC, CO, and other residues of incomplete combustion presents a major threat to the cleanliness of the atmosphere, it has been conceived of to operate the engine during engine idling condition by supplying thereto via the intake system an air-fuel mixture of air/fuel ratio substantially richer than stoichiometric, and then to inject a substantial amount of secondary air into the exhaust system of the engine, upstream of the three way catalytic converter, in sufficient amount to render the air/fuel ratio of the exhaust gases definitely leaner than stoichiometric at the time that the exhaust gases enter the three way catalytic converter. As a result, as noted above, the oxidizing reaction for converting HC, CO, and other products of incomplete combustion in the hot exhaust gases of the internal combustion engine into harmless end products continues satisfactorily, and although the reducing reaction for converting nitrogen oxides in the exhaust gases into harmless end products will substantially cease, this will not provide any great problem in practice, since as explained above the amounts of nitrogen oxides currently being produced are rather small. Further, because the air/fuel ratio of the idling air-fuel mixture being supplied to the internal combustion engine is substantially richer than stoichiometric, stumbling, surging, stalling, and irregular operation of the internal combustion engine during idling are substantially prevented.

A problem that has arisen with this prior art concept, in adapting it to actual automobiles of the sort that are being produced nowadays, is that it is common at the present time for carburetors of internal combustion engines for automobiles to be provided with so called idle up devices, which increase the idling speed of the internal combustion engine in response to increased idling load on the engine. For instance, conventionally and commonly engine idle up is performed when an air conditioner compressor is required to be operated during engine idling operation. Various other factors may also cause engine idle up to be performed, such as the operation of a power steering pump, or the like. The adaptation of the above concept of air/fuel ratio control to these cases has not been straightforward.

SUMMARY OF THE INVENTION

Accordingly, it is the primary object of the present invention to provide an air/fuel ratio control system for an internal combustion engine equipped with a carburetor with idle up capability and a three way catalytic converter, which can provide smooth idling operation of the internal combustion engine, both during the non idle up idling engine operational condition and also during the idle up idling engine operational condition.

It is a further object of the present invention to provide an air/fuel ratio control system for an internal combustion engine equipped with a carburetor with idle up capability and a three way catalytic converter, in which the air/fuel ratio of the exhaust gases of the internal combustion engine is kept near stoichiometric when the engine is not idling, but in which the air/fuel ratio of the exhaust gases is kept substantially leaner than stoichiometric when the engine is idling, both in the idle up idling mode and in the non idle up idling mode.

It is a further object of the present invention to provide an air/fuel ratio control system for an internal combustion engine equipped with a carburetor with idle up capability and a three way catalytic converter, in which the engine is operated with an air-fuel mixture whose air/fuel ratio is substantially the stoichiometric one when the engine is not idling, but in which the engine is operated with an air-fuel mixture whose air/fuel ratio is substantially richer than stoichiometric, during both the idle up idling mode, and during the non idle up idling mode.

It is a further object of the present invention to provide an air/fuel ratio control system for an internal combustion engine equipped with a carburetor with idle up capability and a three way catalytic converter, which operates in the above described feedback fashion to keep the air/fuel ratio of the air-fuel mixture supplied to the engine near the stoichiometric one when the internal combustion engine is operating in a load bearing operational condition, but in which the feedback operation is interrupted when the internal combustion engine is put into the idling state, whether this be the idle up idling state or the non idle up idling state, and instead secondary air is commenced to be supplied into the exhaust system of the engine.

It is a further object of the present invention to provide an air/fuel ratio control system for an internal combustion engine equipped with a carburetor with idle up capability and a three way catalytic converter, which prevents stumbling and stalling of the internal combustion engine during the idling state, whether this be the idle up idling state or the non idle up idling state.

It is a further object of the present invention to provide such an air/fuel ratio control system as detailed above for an internal combustion engine equipped with a carburetor with vacuum actuated idle up capability and a three way catalytic converter, which is conveniently integrated with the vacuum actuation of the idle up of the carburetor.

It is a yet further object of the present invention to provide such an air/fuel ratio control system as detailed above for an internal combustion engine equipped with a carburetor with electrically actuated idle up capability and a three way catalytic converter, which is conveniently integrated with the electrical actuation of the idle up of the carburetor.

It is a yet further object of the present invention to provide an air/fuel ratio control system as detailed above for an internal combustion engine equipped with a carburetor with idle up capability and a three way catalytic converter, which injects additional primary air into the intake manifold downstream of the carburetor.

It is a yet further object of the present invention to provide an air/fuel ratio control system for an internal combustion engine equipped with a carburetor with idle up capability and a three way catalytic converter, which injects additional primary air into the carburetor as additional bleed air.

According to the present invention, these and other objects are accomplished by, for an internal combustion engine comprising an exhaust system and a fuel intake passage system comprising a carburetor which comprises an intake throat, a throttle valve mounted in said intake throat, and an idle up device which selectively acts on said throttle valve so as to control its most closed position to be either a first idling position near its fully closed position or a second idle up idling position slightly more open that said first idling position; said carburetor in its basic operational mode tending to deliver an air/fuel mixture richer than stoichiometric: an air/fuel ratio control system, comprising: (a) an oxygen sensor for detecting the concentration of oxygen in the exhaust gases in said exhaust system; (b) a means for adjusting the air/fuel ratio of the air/fuel mixture being supplied to the engine through said fuel intake passage system towards the leaner, which receives the signal from said oxygen sensor, and which functions only when said oxygen sensor is detecting no oxygen in the exhaust gases in said exhaust system; (c) a means for supplying a flow of secondary air into said exhaust system during idling engine operation, upstream of said oxygen sensor, in a flow amount sufficient to render the exhaust gases in said exhaust system leaner than stoichiometric, said means thus supplying secondary air when and only when it receives supply of a controlling vacuum; (d) a first vacuum takeout port formed at a point in said intake throat which is downstream of said throttle valve when said throttle valve is in said first idling position but which is upstream of said throttle valve when said throttle valve is opened a slight amount from said first idling position; (e) a second vacuum takeout port formed at a point in said intake throat which is downstream of said throttle valve when said throttle valve is in said second idle up idling position but which is upstream of said throttle valve when said throttle valve is opened a slight amount from said second idle up idling position; and (f) a vacuum switching system, which provides supply of vacuum from said first vacuum take out port to said means for supplying secondary air as said controlling vacuum when said idle up device is controlling the most closed position of said throttle valve to be said first idling position, and which provides supply of vacuum from said second vacuum take out port to said means for supplying secondary air as said controlling vacuum when said idle up device is controlling the most closed position of said throttle valve to be said second idle up idling position.

According to such a structure, when no idle up is being performed by said idle up device and the most closed position of said throttle valve is said first idling position, then said vacuum switching system provides vacuum from said first vacuum take out port to said secondary air supplying means as controlling vacuum, so that said secondary air supplying means only supplies secondary air when said throttle valve is in said first idling position, otherwise during non idling operation of the engine providing no secondary air so that feedback action of said air/fuel ratio adjusting means based upon the signal from said oxygen sensor keeps the air/fuel ratio of the air-fuel mixture supplied to the engine near stoichiometric; and, when idle up is being performed by said idle up device and the most closed position of said throttle valve is said second idling position, then said vacuum switching system provides vacuum from said second vacuum take out port to said secondary air supplying means as controlling vacuum, so that said secondary air supplying means only supplies secondary air when said throttle valve is in said second idling position, otherwise during non idling operation of the engine providing no secondary air so that again feedback action of said air/fuel ratio adjusting means based upon the signal from said oxygen sensor keeps the air/fuel ratio of the air-fuel mixture supplied to the engine near stoichiometric.

Further, according to a particular aspect of the present invention, these and other objects are more particularly and concretely accomplished by such an air/fuel ratio control system as described above, wherein said means for adjusting the air/fuel ratio of the air/fuel mixture being supplied to the engine through said fuel intake passage system towards the leaner injects air into said intake passage system downstream of said carburetor.

According to such a structure, this additional air mixes with the air-fuel mixture which has been produced by the carburetor so as to produce the air-fuel mixture which is combusted in the engine, the air/fuel ratio of which is kept within a narrow range about the stoichiometric condition by the aforesaid feedback action of said air/fuel ratio adjusting means.

Alternatively, according to a particular aspect of the present invention, these and other objects may be more particularly and concretely accomplished by such an air/fuel ratio control system as first described above, said carburetor being formed with an auxiliary air bleed passage, wherein said means for adjusting the air/fuel ratio of the air/fuel mixture being supplied to the engine through said fuel intake passage system towards the leaner injects air into said auxiliary air bleed passage.

According to such a structure, this additional air mixes within the carburetor with the air-fuel mixture which is being produced by the carburetor so as to produce the air-fuel mixture which is combusted in the engine, the air/fuel ratio of which is kept within a narrow range about the stoichiometric condition by the aforesaid feedback action of said air/fuel ratio adjusting means.

Further, according to a particular aspect of the present invention, these and other objects are yet more particularly and concretely accomplished by such an air/fuel ratio control system of either of the particular sorts described above, for an internal combustion engine wherein said idle up device comprises a vacuum actuator which when supplied with vacuum moves a stop against which said throttle valve abuts in its idling position in the direction of increasing idling speed, and an electric control device which despatches an electrical signal when idle up is to be performed: wherein said vacuum switching system comprises an electromagnetic switching valve with a first, a second, and a third port, a one way valve, a vacuum conduit, and a throttling element; said second and said third ports of said electromagnetic switching valve being communicated together when said electromagnetic switching valve is not supplied with actuating electrical energy, and said first and said second ports of said electromagnetic switching valve being communicated together when said electromagnetic switching valve is supplied with actuating electrical energy; said electromagnetic switching valve being supplied with said electrical signal as supply of actuating electrical energy; said third port of said electromagnetic switching valve being communicated to atmosphere; said first port of said electromagnetic switching valve being communicated to said second vacuum take out port; and said second port of said electromagnetic switching valve being communicated to said vacuum actuator of said idle up device and also being communicated via said one way valve against its direction of transmitting fluid to a first end of said conduit, the other end of said conduit being communicated to said means for supplying a flow of secondary air into said exhaust system during idling engine operation so as to supply said controlling vacuum thereto; an intermediate part of said conduit being also communicated via said throttling element to said first vacuum take out port.

According to such a structure, when no idle up is to be performed and said electric control device is not outputting any electrical signal to said electromagnetic switching valve, then vacuum at said first vacuum take out port is transmitted via said throttling element to said conduit and thereby to said means for supplying secondary air as said controlling vacuum, not escaping through said one way valve due to its one way action, while vacuum at said second vacuum take out port is not transmitted anywhere, and further said vacuum actuator is communicated to said second port of said electromagnetic switching valve and thence to said third port thereof and thence to atmosphere, thus not being actuated and thus not performing carburetor idle up; but on the other hand, when idle up is to be performed and said electric control device is outputting an electrical signal to said electromagnetic switching valve, then vacuum at said second vacuum take out port is transmitted to said first port of said electromagnetic switching valve, whence it is transmitted to said second port thereof, whence it is transmitted to said vacuum actuator to actuate it and to perform carburetor idle up and is also transmitted via said one way valve to said conduit which transmits it to said means for supplying secondary air as said controlling vacuum, not meanwhile substantially leaking out through said first vacuum take out port and being attenuated due to the provision of said throttling element.

Alternatively, according to a particular aspect of the present invention, these and other objects may be yet more particularly and concretely accomplished by such an air/fuel ratio control system of either of the particular sorts described above, for an internal combustion engine wherein said idle up device comprises an electric actuator which when supplied with actuating electrical energy moves a stop against which said throttle valve abuts in its idling position in the direction of increasing idling speed, and an electric control device which dispatches an electrical signal to said electric actuator when idle up is to be performed: wherein said vacuum switching system comprises an electromagnetic switching valve with a first, a second, and a third port; said second and said third ports of said electromagnetic switching valve being communicated together when said electromagnetic switching valve is not supplied with actuating electrical energy, and said first and said second ports of said electromagnetic switching valve being communicated together when said electromagnetic switching valve is supplied with actuating electrical energy; said electromagnetic switching valve being supplied with said electrical signal as supply of actuating electrical energy; said third port of said electromagnetic switching valve being communicated to said first vacuum take out port; said first port of said electromagnetic switching valve being communicated to said second vacuum take out port; and said second port of said electromagnetic switching valve being communicated to said means for supplying a flow of secondary air into said exhaust system during idling engine operation so as to supply said controlling vacuum thereto.

According to such a structure, when no idle up is to be performed and said electric control device is not outputting any electrical signal to said electromagnetic switching valve and to said electric actuator, then vacuum at said first vacuum take out port is transmitted to said third port of said electromagnetic switching valve, whence it is transmitted to said second port thereof and therefrom to said means for supplying secondary air as said controlling vacuum, while vacuum at said second vacuum take out port is not transmitted anywhere, and further said electrical actuator is not being actuated and thus not performing carburetor idle up; but on the other hand, when idle up is to be performed and said electric control device is outputting an electrical signal to said electromagnetic switching valve and to said electric actuator, then vacuum at said second vacuum take out port is transmitted to said first port of said electromagnetic switching valve, whence it is transmitted to said second port thereof and therefrom to said means for supplying secondary air as said controlling vacuum, while vacuum at said first vacuum take out port is not transmitted anywhere, and further said electrical actuator is actuated and thus is performing carburetor idle up.

BRIEF DESCRIPTION OF THE DRAWINGS

The present invention will now be shown and described with reference to several preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The present invention will now be described with reference to several preferred embodiments thereof, and with reference to the appended drawings.

Construction of the First Preferred Embodiment

Figure 1:
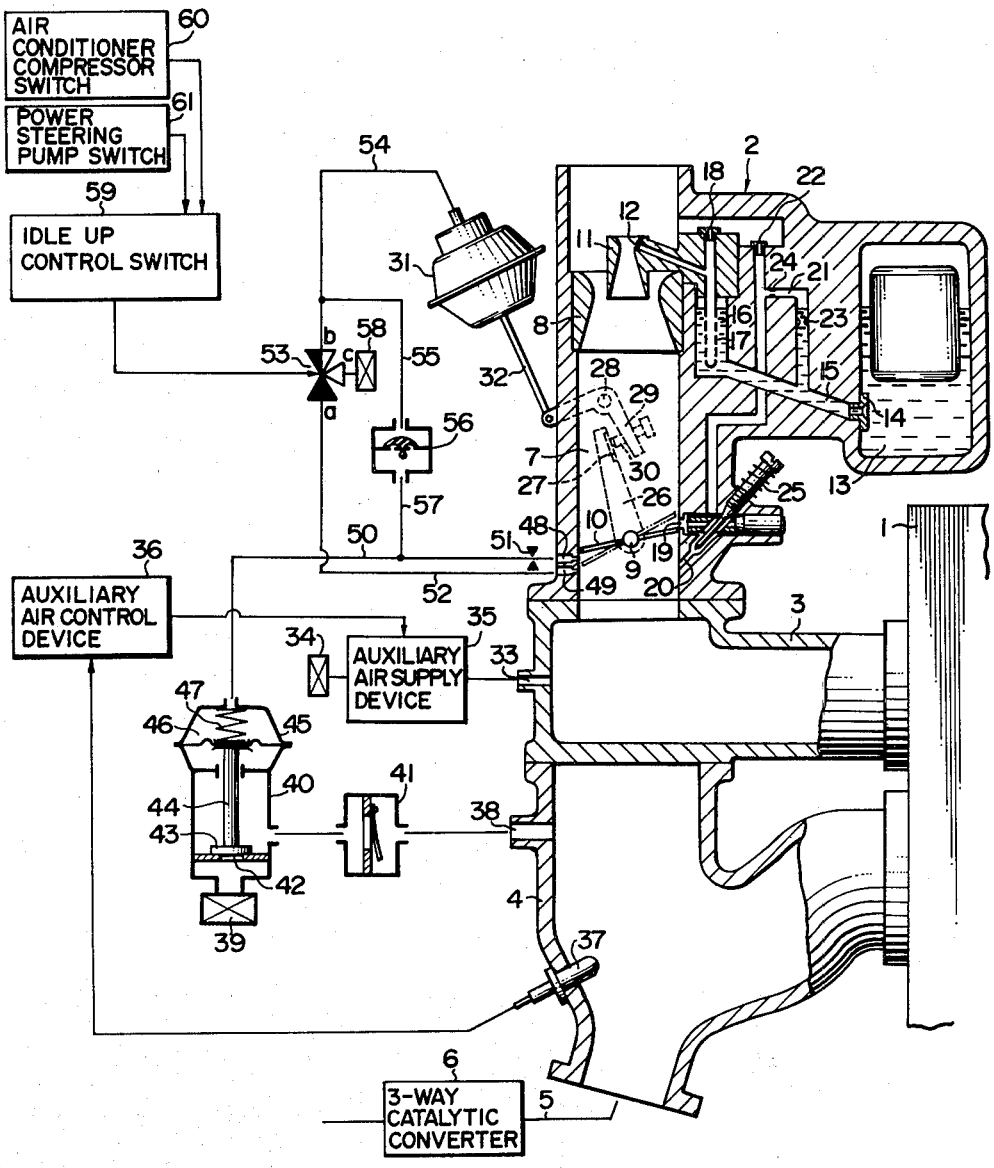
FIG. 1 is a part sectional part schematic constructional view, partially showing an internal combustion engine and the intake and exhaust systems thereof, and also showing in detail an air/fuel ratio control system which is a first preferred embodiment of the present invention as fitted to this internal combustion engine.

FIG. 1 is a part sectional part schematic view, showing an internal combustion engine 1 which is equipped with a first preferred embodiment of the air/fuel ratio control system according to the present invention, and also showing various other control mechanisms associated therewith. The reference numeral 2 denotes a carburetor which supplies fuel/air mixture to said internal combustion engine 1 through an intake manifold 3. The fuel/air mixture is combusted in the combustion chambers, not shown, of the internal combustion engine 1, and the exhaust gases resulting from this combustion are exhausted through an exhaust manifold 4 into an exhaust tube 5, at an intermediate part of which there is fitted a three-way catalytic converter 6 of a per se well known sort; the exhaust tube 5 and the three-way catalytic converter 6 are only shown schematically in FIG. 1, because the details of their construction are not relevant.

An air passage or throat 7 is formed through the body of the carburetor 2, and a large venturi 8 is fitted at an upstream position in this throat 7. Downstream of the large venturi 8 within the carburetor throat 7 there is fitted a butterfly type throttle valve 10, which is fixed to a throttle shaft 9 which is rotatably mounted in the walls of the throat 7, and which can rotate between a position as seen in solid lines in the figure in which it almost completely interrupts flow of gas through the throat 7, and a position in which it is quite wide open. Within the large venturi 8 there is fitted a small venturi 11, and within the small venturi 11 a main fuel nozzle 12 opens.

The carburetor 2 is provided with a float chamber 13, and liquid fuel such as gasoline is kept at a predetermined constant level within this float chamber by a float and valve mechanism, not particularly shown or described here. Via a main fuel jet 14, this fuel flows from the float chamber 13 into a main fuel passage 15, which leads it to a well 16. In the well 16 there is provided an air bleed tube 17 which is pierced with a plurality of small holes for admitting bleed air into the liquid fuel within the well 16 from the atmosphere, via a main air bleed jet 18, in a per se conventional manner.

The body of the carburetor 2 is further provided with a slow port 19 and an idle port 20, which are communicated with one another. A part of the fuel flowing through the main fuel passage 15 is diverted into a slow fuel passage 21, which leads to the slow port 19 and the idle port 20. At an intermediate part of the slow fuel passage 21 there opens a passage which leads to the atmosphere via a slow air bleed jet 22, and upstream of this intermediate part there are fitted within the slow fuel passage 21 a slow fuel jet 23 and an economizer jet 24. Finally, the amount of fuel which is supplied into the throat 7 of the carburetor 2 from the idle port 20 is controlled by an idle adjust screw 25, whose pointed end coapts with the idle port 20 to form a metering orifice.

The general construction of the carburetor 2, and of the various passages and jets therein, is that the carburetor 2 tends to supply an air-fuel mixture whose air/fuel ratio is less than the stoichiometric ratio; in other words, a rich air-fuel mixture, both in the idling operational condition and in the non-idling operational condition wherein the throttle valve 10 is significantly opened.

Now the arrangements for performing so called "idle up" of the carburetor 2 will be explained. Certain parts thereof are shown in FIG. 1 by dashed lines because they are in fact located outside the main body of the carburetor 2, behind the throat 7 from the point of view of the figure. To the throttle shaft 9 there is fixed a throttle lever 26, which extends upwards in the figure, and the upper end of which is formed with a lug 27. An idle up lever 29 of a generally L shape is pivotally attached to the body of the carburetor 2 by a pivot pin 28, and an adjusting screw 30 fitted in the end of one arm of this idle up lever 29 abuts against the lug 27. In this first shown constructional example, the end of the other arm of the idle up lever 29 is connected, via a rod 32, to the diaphragm (not particularly shown) of a diaphragm device 31, whose body is fixed to the body of the carburetor 2, although this is not shown in the figure.

Thus, when the diaphragm chamber (not shown) of the diaphragm device 31 is not supplied with vacuum, then the idle up lever 29 and the adjusting screw 30 are in their positions as shown by dashed lines in the figure, and in this condition when the accelerator pedal (not shown) or other actuating means for the throttle valve 10 is released this throttle valve 10 can return to its so called first idling position as shown by solid lines in FIG. 1, with the lug 29 abutting against the adjusting screw 30 which is in its shown position. On the other hand, when the diaphragm chamber (not shown) of the diaphragm device 31 is supplied with vacuum, then the idle up lever 29 and the adjusting screw 30 are moved, via the rod 32, somewhat in the clockwise direction from their positions as shown by dashed lines in the figure, and in this condition when the accelerator pedal (not shown) or other actuating means for the throttle valve 10 is released this throttle valve 10 can only return to its position as shown by phantom lines in FIG. 1, with the lug 29 abutting against the adjusting screw 30 in its new idle up position, somewhat to the left in FIG. 1 from its shown position. In other words, the throttle valve 10 can only return to a so called second idling or idle up position wherein said throttle valve 10 is a little opened up from said first idling position and therefore provides somewhat more idling fuel-air mixture for the internal combustion engine 1 than would be provided in said first idling position.

In this first preferred embodiment, the means provided for weakening the basically rich air-fuel mixture provided by the carburetor 2 are as follows. An auxiliary air supply port 33 is provided in the inlet manifold 3, and this auxiliary air supply port is connected to the output side of an auxiliary air supply device 35, the input side of which is connected to a clean air supply assembly 34 which may include an air filter and the like. The auxiliary air supply device 35 comprises a valve device for metering the amount of air flowing therethrough, and is itself per se well known. The auxiliary air supply device 35 is controlled by an auxiliary air control device 36, which receives a signal from an oxygen sensor 37 mounted in the exhaust manifold 4. When and only when the oxygen sensor 37 detects no oxygen in the exhaust gases flowing through the exhaust manifold 4, the auxiliary air supply device 35 is activated to feed air into the inlet manifold 3.

Within the exhaust manifold 4 there is provided a secondary air injection port 38. This secondary air injection port 38 is located upstream of the oxygen sensor 37, so that when secondary air is being injected through the port 38 said oxygen sensor 37 is responding to the oxygen content of exhaust gases into which said air has been injected. Air is provided to the secondary air injection port 38, via a one way reed valve 41 of a per se well known construction, through and under the control of a secondary air control valve 40, which takes in this air from the atmosphere via an air intake device 39 which may incorporate an air filter. When the secondary air control valve 40 is opened, in fact, secondary air is sucked into the exhaust manifold 4 by the exhaust pulsation effect. The sizes of the various apertures and passages in this system are so tailored that, when the internal combustion engine 1 is idling and the secondary air control valve 40 is open, the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric.

Air which enters the secondary air control valve 40 passes through a valve port 42, which is controlled by a valve element 43 connected to a valve rod 44 which is coupled to the diaphragm of a diaphragm device 45. A compression coil spring 47 biases the diaphragm of the diaphragm device 45, and the valve rod 44 and the valve element 43, downwards in the figure so as to bias the valve element 43 against the valve port 42. Thus, when no actuating vacuum is supplied to the diaphragm chamber 46 of the diaphragm device 45, then the valve port 42 is closed and no secondary air is allowed to pass through the secondary air injection port 38 into the exhaust manifold 4; but, on the other hand, when actuating vacuum is supplied to the diaphragm chamber 46 of the diaphragm device 45, then the diaphragm thereof and the valve rod 44 and the valve element 43 are moved upwards as seen in the figure, and the valve port 42 is opened by the valve element 43, and thus secondary air is allowed to pass through the secondary air injection port 38 into the exhaust manifold 4.

Now the arrangements for providing actuating vacuum for the diaphragm device 31 which performs the idle up of the carburetor 2 and for the diaphragm device 45 of the secondary air control valve 40 will be described.

Two vacuum take out ports 48 and 49 are provided in the throat 7 of the carburetor 2, near the trailing edge of the throttle valve 10. The first vacuum take out port 48 is so located that it is downstream of the throttle valve 10 when the throttle valve 10 is in its first idling position, and becomes to be upstream of the throttle valve 10 when the throttle valve 10 is opened slightly beyond its first idling position. On the other hand, the second vacuum take out port 49 is so located that it is downstream of the throttle valve 10 when the throttle valve 10 is in its second idling position or idle up position, and becomes to be upstream of the throttle valve 10 when the throttle valve 10 is opened slightly beyond its second idling or idle up position. Thus, in fact, the second vacuum take out port 49 is located very close to, but a little downstream of, the first vacuum take out port 48.

The first vacuum take out port 48 is connected via a conduit 50 to the diaphragm chamber 46 of the diaphragm device 45, and a throttling element 51 is interposed at an upstream part of the conduit 50. The second vacuum take out port 49 is connected via a conduit 52 to a port a of an electromagnetic vacuum switching valve 53.

The electromagnetic vacuum switching valve 53 has three ports a, b, and c. When actuating electrical energy is not being supplied to the electromagnetic vacuum switching valve 53, then the port b thereof is communicated to the port c thereof, while the port a is not communicated to anything; and, on the other hand, when actuating electrical energy is being supplied to the electromagnetic vacuum switching valve 53, then the port b thereof is communicated to the port a thereof, while the port c is not communicated to anything.

The port c of the electromagnetic vacuum switching valve 53 is communicated to the atmosphere via an air intake device 58 which may incorporate an air filter, and the port b of the electromagnetic vacuum switching valve 53 is communicated directly, via a conduit 54, to the diaphragm chamber of the diaphragm device 31, and is also communicated, via a conduit 55, a one way valve 56, and a conduit 57, in that order, to a part of the conduit 50 downstream of the throttling element 51, i.e. on the side of the throttling element 51 towards the secondary air control valve 40. The one way valve 56 is so constructed that it will only allow fluid to flow therethrough in the direction from the conduit 57 towards the conduit 55, and not vice versa; i.e., so that it will only allow vacuum to flow in the opposite direction.

Actuating electrical energy is selectively supplied to the electromagnetic vacuum switching valve 53 by an idle up control device 59 of a per se well known sort, which receives input signals from an air conditioner compressor switch 60 and/or from a power steering pump switch 61, or the like, which depending upon these input signals decides when idle up of the internal combustion engine 1 should be performed, and which when it so decides supplies actuating electrical energy to the electromagnetic vacuum switching valve 53.

Operation of the First Preferred Embodiment

Now the operation of this first preferred embodiment of the air/fuel ratio control system according to the present invention will be explained.

Non Idle up Operation

First, suppose that based upon the output signals from the air conditioner compressor switch 60 and/or the power steering pump switch 61, etc., the idle up control device 59 is deciding that no idle up action needs to be provided for the internal combustion engine 1, and accordingly the idle up control device 59 is not providing any actuating electrical energy for the electromagnetic switching valve 53. In this condition, the port b of the electromagnetic switching valve 53 is communicated to the port c thereof and therethrough to atmosphere, while the port a is not communicated to anything, and therefore atmospheric pressure is admitted to the diaphragm chamber of the diaphragm device 31 (but is not admitted to the conduit 50 via the conduit 57, due to the provision of the one way valve 56 which intercepts air flow in this direction). Thus the rod 32 is not displaced by said diaphragm device 31 in the upwards direction as seen in FIG. 1, and therefore no idle up effect is provided for the throttle valve 10, as explained above; in other words, the maximum closed position of the throttle valve 10 in this condition is its so called first idling position as shown by solid lines in FIG. 1, wherein the first vacuum take out port 48 is downstream of said throttle valve 10. Further, in this non idle up condition any vacuum which is present at the first vacuum take out port 48 is transmitted, via the throttling element 51 which delays its transmission for a short time, to the diaphragm chamber 46 of the diaphragm device 45 of the secondary air control valve 40.

First, let us consider the case of idling operation at this non idle up time, when the throttle valve 10 is in its so called first idling position as shown by solid lines in FIG. 1. As has been previously mentioned, the carburetor 2 is designed to deliver a basically richer mixture than stoichiometric, and hence, since as will be seen hereinafter at this time no injection of auxiliary weakening air is being provided through the auxiliary air supply port 33 by the auxiliary air supply device 35, the internal combustion engine 1 is running with a somewhat rich idling mixture, which is effective for preventing stumbling, misfiring, and stalling. Because the throttle valve 10 is in its so called first idling position as shown by solid lines in FIG. 1, the first vacuum take out port 48 is downstream of said throttle valve 10, and therefore substantial vacuum is present at said first vacuum take out port 48. This vacuum is transmitted, via the throttling element 51 which does not substantially disturb it, and via the conduit 50, to the diaphragm chamber 46 of the secondary air control valve 40. Thereby, the diaphragm of the secondary air control valve 40, and the valve rod 44 attached thereto and the valve element 43, are displaced upwards as seen in the figure, and the valve element 43 is displaced away from the valve port 42, thus opening the valve port 42 and thereby communicating the secondary air injection port 38 with the atmosphere, via the one way reed valve 41, the secondary air control valve 40 which is open, and the air intake device 39. Thereby, as explained previously, due to the exhaust pulsation effect, secondary air is sucked into the exhaust manifold 4 through the intake device 39, the secondary air control valve 40, the one way reed valve 41, and the secondary air injection port 38.

As has also been explained, the sizes of the various apertures and passages in this system are so tailored that at this time the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric. Therefore, the oxygen sensor 37 will continuously detect presence of oxygen in the exhaust gases within the exhaust manifold 4, and will continuously dispatch a signal representative thereof to the auxiliary air control device 36, which will therefore continuously supply such a signal to the auxiliary air supply device 35 as to cause it not to feed any auxiliary air into the inlet manifold 3 through the auxiliary air supply port 33, as mentioned above. Further, during this operational condition, the excess air ratio of the exhaust gases within the exhaust manifold 4 and being fed into the three way catalytic converter 6 through the exhaust tube 5 is substantially over unity—in other words, the exhaust gases have surplus oxygen in them—and therefore the three way catalytic converter 6 is being operated substantially only as an oxidizing catalytic converter, eliminating HC and CO and other products of incomplete combustion in the exhaust gases of the internal combustion engine 1 by an oxidizing reaction, but not substantially operating in the reduction mode to eliminate NOx from the exhaust gases; however, since in this rich idling operational condition of the internal combustion engine 1 the production of NOx is quite low and is not a significant problem in practice, this will be quite acceptable.

Now, suppose that from this non idle up idling condition, wherein the throttle valve 10 is in its first idling position, the throttle valve 10 is opened up to a substantial degree and is maintained in this state for power delivery operation of the internal combustion engine 1. As soon as the throttle valve 10 is opened up, the high degree of inlet manifold vacuum present at the first vacuum take out port 48 drops to substantially zero. Very quickly this substantially atmospheric pressure is transmitted past the throttling element 51 along the conduit 50 to the diaphragm chamber 46 of the secondary air control valve 40. Thereby, the diaphragm of the secondary air control valve 40, and the valve rod 44 attached thereto and the valve element 43, are displaced downwards as seen in the figure due to the biasing effect of the compression coil spring 47, and the valve element 43 is displaced towards and against the valve port 42, thus closing the valve port 42 and thereby breaking the communication of the secondary air injection port 38 with the atmosphere via the one way reed valve 41, the secondary air control valve 40, and the air intake device 39. Thereby the flow of secondary air into the exhaust manifold 4 through the intake device 39, the secondary air control valve 40, the one way reed valve 41, and the secondary air injection port 38 immediately ceases, and does not recommence while the internal combustion engine 1 is in the non idling operational condition.

In this condition, since the basic air-fuel mixture provided by the carburetor 2, in this power operating condition as well as in the idling operational condition, as explained above, is somewhat richer than stoichiometric, the internal combustion engine 1 will initially be running on a richer than stoichiometric mixture. However, very quickly this will result in the excess oxygen present in the exhaust gases within the exhaust manifold 4 disappearing, and therefore the oxygen sensor 37 will cease to dispatch a signal representative of the presence of oxygen, and will start to dispatch a signal representative of absence of oxygen, to the auxiliary air control device 36. This auxiliary air control device 36 will therefore start to supply such a signal to the auxiliary air supply device 35 as to cause it to feed auxiliary air into the inlet manifold 3 through the auxiliary air supply port 33, by the intake pulsation effect, and this will weaken the air/fuel ratio of the air-fuel mixture being supplied to the internal combustion engine 1. In a per se well known manner, by feedback control of the auxiliary air supply device 35 performed by the auxiliary air control device 36, therefore, the air/fuel ratio of the air-fuel mixture provided to the internal combustion engine 1 is brought to be substantially the stoichiometric value, by addition of the proper amount of auxiliary air thereto through the auxiliary air supply port 33. When this substantially stoichiometric air/fuel ratio for the intake gases of the internal combustion engine 1 has been attained, then the excess air ratio of the exhaust gases in the exhaust manifold 4 and passed through the three way catalytic converter 6 will be approximately 1—i.e., these exhaust gases will be near the stoichiometric condition—and therefore the three way catalytic converter 6 will function properly and effectively in its three way catalytic mode of removing not only HC, CO, and other products of incomplete combustion from the exhaust gases by an oxidising reaction, but also of purifying the exhaust gases of NOx by a reducing reaction.

Thus, as has been explained above, in the case of non idle up operation, the transition between the idling mode of operation, wherein the internal combustion engine 1 is operated with an idling air-fuel mixture substantially richer than stoichiometric and the three way catalytic converter 6 is operated substantially only in its oxidizing mode of operation and no auxiliary air is supplied through the auxiliary air supply port 33 while secondary air is supplied through the secondary air injection port 38, and the non idling mode of operation, wherein the internal combustion engine 1 is operated with an air-fuel mixture substantially stoichiometric and the three way catalytic converter 6 is operated in both its oxidizing mode of operation and its reducing mode of operation and auxiliary air is supplied through the auxiliary air supply port 33 while no secondary air is supplied through the secondary air injection port 38, is performed quickly, reliably, and simply, according to the function of the shown first preferred embodiment of the air/fuel ratio control system according to the present invention.

Idle Up Operation

Now, on the other hand, suppose that based upon the output signals from the air conditioner compressor switch 60 and/or the power steering pump switch 61, etc., the idle up control device 59 is deciding that idle up action needs to be provided for the internal combustion engine 1, and accordingly the idle up control device 59 is providing actuating electrical energy for the electromagnetic switching valve 53. In this condition, the port a of the electromagnetic switching valve 53 is communicated to the port b thereof, while the port c is not communicated to anything. Therefore, when the throttle pedal or other throttle actuating device of the vehicle incorporating this system is released, so as to close the throttle valve 10, the high amount of vacuum which is immediately thus caused to be present at the second vacuum take out port 49 is transmitted, via the vacuum conduit 52, to the port a of the electromagnetic switching valve 53, whence this vacuum is transmitted to the diaphragm chamber of the diaphragm device 31 and actuates the diaphragm (not shown) thereof. Thus the rod 32 is displaced by said diaphragm device 31 in the upwards direction as seen in FIG. 1, and therefore an idle up effect is provided for the throttle valve 10, as explained previously; in other words, the maximum closed position of the throttle valve 10 in this condition is its so called second idling or idle up position as shown by the phantom lines in FIG. 1, wherein the first vacuum take out port 48 is in fact upstream of said throttle valve 10, but the second vacuum take out port 49 is just downstream of said throttle valve 10. Further, in this idle up condition any vacuum which is present at the second vacuum take out port 49 is transmitted, via the conduit 52, the electromagnetic switching valve 53, the conduit 54, the conduit 55, the one way valve 56, the conduit 57, and the conduit 50, to the diaphragm chamber 46 of the diaphragm device 45 of the secondary air control valve 40. In this connection, by the way, substantial escape of such vacuum through the upstream part of the conduit 50 in the reverse direction through the first vacuum take out port 48 is prevented by the provision of the throttling element 51.

First, let us consider the case of idling operation at this idle up time, when the throttle valve 10 is in its so called second idling position as shown by the phantom lines in FIG. 1. As has been previously mentioned, the carburetor 2 is designed to deliver a basically richer mixture than stoichiometric, and hence, since as will be seen hereinafter at this time no injection of auxiliary weakening air is being provided through the auxiliary air supply port 33 by the auxiliary air supply device 35, the internal combustion engine 1 is running with a somewhat rich idling mixture, which is effective for preventing stumbling, misfiring, and stalling. Because the throttle valve 10 is in its so called second idling position as shown by phantom lines in FIG. 1, the second vacuum take out port 49 is downstream of said throttle valve 10, and therefore substantial vacuum is present at said second vacuum take out port 49. This vacuum is transmitted, via the conduit 52, the electromagnetic switching valve 53 whose ports a and b are as stated above communicated to one another at this time, via the conduits 54 and 55, via the one way valve 56, and via the conduits 57 and 50, to the diaphragm chamber 46 of the secondary air control valve 40 (not being substantially attenuated by leakage past the throttling element 51 to the first vacuum take out port 48, due to the high flow resistance of said throttling element 51). Thereby, the diaphragm of the secondary air control valve 40, and the valve rod 44 attached thereto and the valve element 43, are displaced upwards as seen in the figure, and the valve element 43 is displaced away from the valve port 42, thus opening the valve port 42 and thereby communicating the secondary air injection port 38 with the atmosphere, via the one way reed valve 41, the secondary air control valve 40 which is open, and the air intake device 39. Thereby, as explained previously, due to the exhaust pulsation effect, secondary air is sucked into the exhaust manifold 4 through the intake device 39, the secondary air control valve 40, the one way reed valve 41, and the secondary air injection port 38.

As has also been previously stated, the sizes of the various apertures and passages in this system are so tailored that at this time the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric. Therefore, the oxygen sensor 37 will continuously detect presence of oxygen in the exhaust gases within the exhaust manifold 4, and will continuously dispatch a signal representative thereof to the auxiliary air control device 36, which will therefore continuously supply such a signal to the auxiliary air supply device 35 as to cause it not to feed any auxiliary air into the inlet manifold 3 through the auxiliary air supply port 33, as mentioned above. Further, during this operational condition, the excess air ratio of the exhaust gases within the exhaust manifold 4 and being fed into the three way catalytic converter 6 through the exhaust tube 5 is substantially over unity—in other words, the exhaust gases have surplus oxygen in them—and therefore the three way catalytic converter 6 is being operated substantially only as an oxidizing catalytic converter, eliminating HC and CO and other products of incomplete combustion in the exhaust gases of the internal combustion engine 1 by an oxidizing reaction, but not substantially operating in the reduction mode to eliminate NOx from the exhaust gases; however, since in this rich idle up idling operational condition of the internal combustion engine 1 the production of NOx is quite low and is not a significant problem in practice, this will be quite acceptable.

Now, suppose that from this idle up idling condition, wherein the throttle valve 10 is in its second or idle up idling position, the throttle valve 10 is opened up to a substantial degree and is maintained in this state for power delivery operation of the internal combustion engine 1. As soon as the throttle valve 10 is opened up, the high degree of inlet manifold vacuum present at the second vacuum take out port 49 drops to substantially zero. Very quickly this substantially atmospheric pressure is transmitted via the conduit 52, the electromagnetic switching valve 53 whose ports a and b are communicated to one another at this time, via the conduits 54 and 55, via the one way valve 56, and via the conduits 57 and 50, to the diaphragm chamber 46 of the secondary air control valve 40. Thereby, the diaphragm of the secondary air control valve 40, and the valve rod 44 attached thereto and the valve element 43, are displaced downwards as seen in the figure due to the biasing effect of the compression coil spring 47, and the valve element 43 is displaced towards and against the valve port 42, thus closing the valve port 42 and thereby breaking the communication of the secondary air injection port 38 with the atmosphere via the one way reed valve 41, the secondary air control valve 40, and the air intake device 39. Thereby the flow of secondary air into the exhaust manifold 4 through the intake device 39, the secondary air control valve 40, the one way reed valve 41, and the secondary air injection port 38 immediately ceases, and does not recommence while the internal combustion engine 1 is in the non idling operational condition.

In this condition, since the basic air-fuel mixture provided by the carburetor 2, in this power operating condition as well as in the idle up idling operational condition, as explained above, is somewhat richer than stoichiometric, the internal combustion engine 1 will initially be running on a richer than stoichiometric mixture. However, very quickly this will result in the excess oxygen present in the exhaust gases within the exhaust manifold 4 disappearing, and therefore the oxygen sensor 37 will cease to dispatch a signal representative of the presence of oxygen, and will start to dispatch a signal representative of absence of oxygen, to the auxiliary air control device 36. This auxiliary air control device 36 will therefore start to supply such a signal to the auxiliary air supply device 35 as to cause it to feed, by the intake pulsation effect, auxiliary air into the inlet manifold 3 through the auxiliary air supply port 33, and this will weaken the air/fuel ratio of the air-fuel mixture being supplied to the internal combustion engine 1. In a per se well known manner, by feedback control of the auxiliary air supply device 35 performed by the auxiliary air control device 36, therefore, the air/fuel ratio of the air-fuel mixture provided to the internal combustion engine 1 is brought to be substantially the stoichiometric value, by addition of the proper amount of auxiliary air thereto through the auxiliary air supply port 33. When this substantially stoichiometric air/fuel ratio for the intake gases of the internal combustion engine 1 has been attained, then the excess air ratio of the exhaust gases in the exhaust manifold 4 and passed through the three way catalytic converter 6 will be approximately 1—i.e., these exhaust gases will be near the stoichiometric condition—and therefore the three way catalytic converter 6 will function properly and effectively in its three way catalytic mode of removing not only HC, CO, and other products of incomplete combustion from the exhaust gases by an oxidising reaction, but also of purifying the exhaust gases of NOx by a reducing reaction.

Thus, as has been explained above, in the case of idle up operation, the transition between the idle up idling mode of operation, wherein the internal combustion engine 1 is operated with an idle up idling air-fuel mixture substantially richer than stoichiometric and the three way catalytic converter 6 is operated substantially only in its oxidizing mode of operation and no auxiliary air is supplied through the auxiliary air supply port 33 while secondary air is supplied through the secondary air injection port 38, and the non idling mode of operation, wherein the internal combustion engine 1 is operated with an air-fuel mixture substantially stoichiometric and the three way catalytic converter 6 is operated in both its oxidizing mode of operation and its reducing mode of operation and auxiliary air is supplied through the auxiliary air supply port 33 while no secondary air is supplied through the secondary air injection port 38, is performed quickly, reliably, and simply, according to the function of the shown first preferred embodiment of the air/fuel ratio control system according to the present invention.

In summary, as will be clear from the above, in both the non idle up mode of operation of the shown first preferred embodiment of the air/fuel ratio control system according to the present invention, and the idle up mode of operation thereof: when the throttle valve 10 is in its idling position (respectively either the non idle up idling position or the idle up idling position) then the internal combustion engine 1 is operated with an air-fuel mixture with an air/fuel ratio which is substantially richer than the stoichiometric one, which is effective for preventing stumbling, misfiring, and stalling of said internal combustion engine 1 during idling; while, on the other hand, when the throttle valve 10 is moved away from its idling position (whichever of the above non idle up or idle up idling positions said idling position may respectively currently be) by even a small amount, then the internal combustion engine 1 is operated with an air-fuel mixture with an air/fuel ratio which is substantially stoichiometric, which is effective for promoting proper operation of the three way catalytic converter 6 in its three way operational mode.

Construction of the Second Preferred Embodiment

Figure 2:
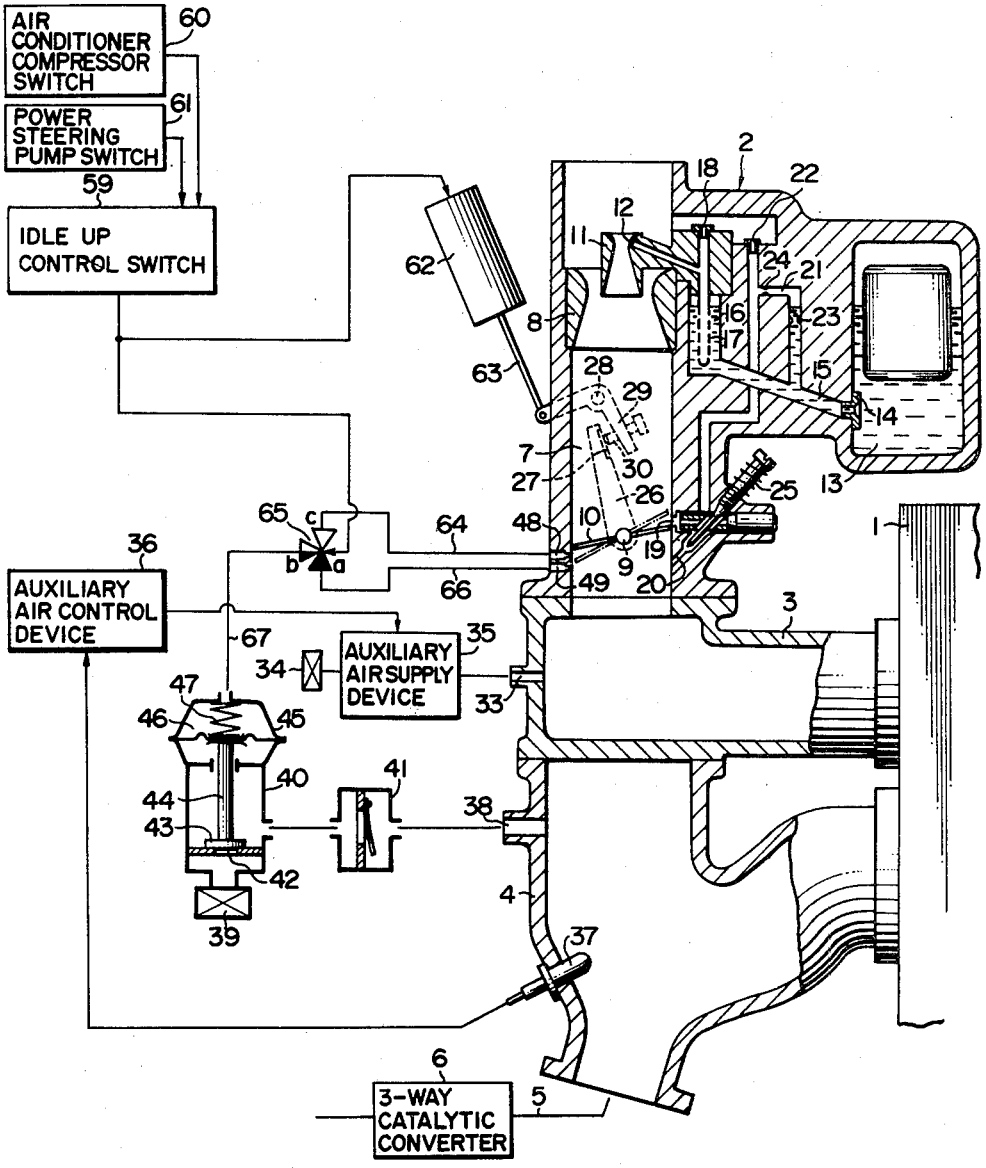
FIG. 2 is a part sectional part schematic constructional view, similar to FIG. 1, partially showing an internal combustion engine and the intake and exhaust systems thereof, and also showing in detail an air/fuel ratio control system which is a second preferred embodiment of the present invention as fitted to this internal combustion engine.

In FIG. 2, there is shown a part sectional view of a second preferred embodiment of the air/fuel ratio control system according to the present invention, in a fashion similar to FIG. 1. In FIG. 2, parts of the second preferred embodiment shown, which correspond to parts of the first preferred embodiment shown in FIG. 1, and which have the same functions, are designated by the same reference numerals and symbols as in that figure.

In FIG. 2, there is again shown an internal combustion engine 1, which is now equipped with a second preferred embodiment of the air/fuel ratio control system according to the present invention. The reference numeral 2 again denotes a carburetor which supplies fuel/air mixture to said internal combustion engine 1 through an intake manifold 3. The fuel/air mixture is combusted in the combustion chambers, not shown, of the internal combustion engine 1, and the exhaust gases resulting from this combustion are again exhausted through an exhaust manifold 4 into an exhaust tube 5, at an intermediate part of which there is again fitted a three-way catalytic converter 6 of a per se well known sort; the exhaust tube 5 and the three-way catalytic converter 6 are again only shown schematically in FIG. 2, because the details of their construction are not relevant.

The details of the internal construction of the carburetor 2 are exactly the same as those of the carburetor 2 shown with regard to the description of the first preferred embodiment of the air/fuel ratio control system according to the present invention, and hence explanation thereof is omitted here in order to avoid redundancy of description. The general construction of the carburetor 2, and of the various passages and jets therein, again with regard to this second preferred embodiment, is that the carburetor 2 tends to supply an air-fuel mixture whose air/fuel ratio is less than the stoichiometric ratio; in other words, a rich air-fuel mixture, both in the idling operational condition and in the non-idling operational condition wherein the throttle valve 10 is significantly opened.

Now the arrangements for performing so called "idle up" of the carburetor 2 will be explained, which differ in this case. As before, certain parts thereof are shown in FIG. 2 by dashed lines because they are in fact located outside the main body of the carburetor 2, behind the throat 7 from the point of view of the figure. To the throttle shaft 9 there is fixed a throttle lever 26, which extends upwards in the figure, and the upper end of which is formed with a lug 27. An idle up lever 29 of a generally L shape is pivotally attached to the body of the carburetor 2 by a pivot pin 28, and an adjusting screw 30 fitted in the end of one arm of this idle up lever 29 abuts against the lug 27. In this second particular construction, however, in contradistinction to the first construction shown in FIG. 1, the end of the other arm of the idle up lever 29 is connected to the plunger 63 of a solenoid device 62, whose body is fixed to the body of the carburetor 2, although this is not shown in the figure.

Thus, when the coil (not shown) of the solenoid device 62 is not supplied with actuating electrical energy, then the idle up lever 29 and the adjusting screw 30 are in their positions as shown by dashed lines in the figure, and in this condition when the accelerator pedal (not shown) or other actuating means for the throttle valve 10 is released this throttle valve 10 can return to its so called first idling position as shown by solid lines in FIG. 2, with the lug 29 abutting against the adjusting screw 30 which is in its shown position. On the other hand, when the coil (not shown) of the solenoid device 62 is supplied with actuating electrical energy, then the idle up lever 29 and the adjusting screw 30 are moved, via the rod 32, somewhat in the clockwise direction from their positions as shown by dashed lines in the figure, and in this condition when the accelerator pedal (not shown) or other actuating means for the throttle valve 10 is released this throttle valve 10 can only return to its position as shown by phantom lines in FIG. 2, with the lug 29 abutting against the adjusting screw 30 in its new idle up position, somewhat to the left in FIG. 2 from its shown position. In other words, the throttle valve 10 can only return to a so called second idling or idle up position wherein said throttle valve 10 is a little opened up from said first idling position and therefore provides somewhat more idling fuel-air mixture for the internal combustion engine 1 than would be provided in said first idling position.

In this second preferred embodiment, the construction of the system for selectively providing auxiliary air into the inlet manifold 3 in order to weaken the somewhat richer than stoichiometric air-fuel mixture which is being provided by the carburetor 2, comprising the auxiliary air supply port 33, the auxiliary air supply device 35, the clean air supply assembly 34, the auxiliary air control device 36, and the oxygen sensor 37, is exactly the same as in the first preferred embodiment of the air/fuel ratio control device according to the present invention shown in FIG. 1, and hence explanation thereof is omitted here in order to avoid redundancy of description.

Within the exhaust manifold 4 there is again provided a secondary air injection port 38, upstream of the oxygen sensor 37, which in exactly the same way as in the first preferred embodiment shown in FIG. 1 is selectively provided with air via a one way reed valve 41 of a per se well known construction, through and under the control of a secondary air control valve 40, which takes in this air from the atmosphere via an air intake device 39 which may incorporate an air filter. When the secondary air control valve 40 is opened, again, secondary air is sucked into the exhaust manifold 4 by the exhaust pulsation effect. Again, the sizes of the various apertures and passages in this system are so tailored that, when the internal combustion engine 1 is idling and the secondary air control valve 40 is open, the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric.

The details of the internal construction of the secondary air control valve 40 are exactly the same as those of the secondary air control valve 40 shown with regard to the description of the first preferred embodiment of the air/fuel ratio control system according to the present invention, and hence explanation thereof is omitted here in order to avoid redundancy of description. Now the arrangements for providing actuating vacuum for the diaphragm device 45 of the secondary air control valve 40 will be described.

As before, two vacuum take out ports 48 and 49 are provided in the throat 7 of the carburetor 2, near the trailing edge of the throttle valve 10. The first vacuum take out port 48 is so located that it is downstream of the throttle valve 10 when the throttle valve 10 is in its first idling position, and becomes to be upstream of the throttle valve 10 when the throttle valve 10 is opened slightly beyond its first idling position. On the other hand, the second vacuum take out port 49 is so located that it is downstream of the throttle valve 10 when the throttle valve 10 is in its second idling position or idle up position, and becomes to be upstream of the throttle valve 10 when the throttle valve 10 is opened slightly beyond its second idling or idle up position. Thus, in fact, the second vacuum take out port 49 is located very close to, but a little downstream of, the first vacuum take out port 48, in a fashion identical to that of the first preferred embodiment.

The first vacuum take out port 48 is connected via a conduit 64 to a port c of an electromagnetic vacuum switching valve 65. The second vacuum take out port 49 is connected via a conduit 66 to another port a of said electromagnetic vacuum switching valve 65. And the port b of the electromagnetic vacuum switching valve 65 is communicated directly, via a conduit 67, to the diaphragm chamber 46 of the diaphragm device 45 of the secondary air control valve 40.

The communications between the ports a, b, and c of the electromagnetic vacuum switching valve 65 are as follows. When actuating electrical energy is not being supplied to the electromagnetic vacuum switching valve 65, then the port b thereof is communicated to the port c thereof, while the port a is not communicated to anything; and, on the other hand, when actuating electrical energy is being supplied to the electromagnetic vacuum switching valve 65, then the port b thereof is communicated to the port a thereof, while the port c is not communicated to anything.

Actuating electrical energy is selectively supplied both to the electromagnetic vacuum switching valve 65 and to the solenoid device 62, in parallel, by an idle up control device 59 of a sort identical to the one shown with regard to the first preferred embodiment of the present invention, which receives input signals from an air conditioner compressor switch 60 and/or from a power steering pump switch 61, or the like, which depending upon these input signals decides when idle up of the internal combustion engine 1 should be performed, and which when it so decides supplies actuating electrical energy both to the electromagnetic vacuum switching valve 65 and to the solenoid device 62.

Thus it will be seen that this second preferred embodiment of the air/fuel ratio control system according to the present invention is in fact simpler in construction than is the first preferred embodiment, and is also simpler in conception, because of the use of an electrical actuator (the solenoid device 62) for performing idle up of the carburetor 2.

Operation of the Second Preferred Embodiment Non Idle Up Operation

First, suppose that based upon the output signals from the air conditioner compressor switch 60 and/or the power steering pump switch 61, etc., the idle up control device 59 is deciding that no idle up action needs to be provided for the internal combustion engine 1, and accordingly the idle up control device 59 is not providing any actuating electrical energy for the solenoid device 62 or for the electromagnetic switching valve 65. In this condition, the port b of the electromagnetic switching valve 65 is communicated to the port c thereof, while the port a is not communicated to anything, and therefore in this non idle up condition any vacuum which is present at the first vacuum take out port 48 is transmitted, via the electromagnetic switching valve 65, to the diaphragm chamber 46 of the diaphragm device 45 of the secondary air control valve 40. Further, no actuating electrical energy is provided to the solenoid device 62 by the idle up control device 59, and thus the rod 32 is not displaced by said solenoid device 62 in the upwards direction as seen in FIG. 2, and therefore no idle up effect is provided for the throttle valve 10, as explained above; in other words, the maximum closed position of the throttle valve 10 in this condition is its so called first idling position as shown by solid lines in FIG. 2, wherein the first vacuum take out port 48 is downstream of said throttle valve 10.

First, let us consider the case of idling operation at this non idle up time, when the throttle valve 10 is in its so called first idling position as shown by solid lines in FIG. 2. As in the case of the carburetor to which the first preferred embodiment was applied, the carburetor 2 of this second preferred embodiment is designed to deliver a basically richer mixture than stoichiometric, and hence, since as will be seen hereinafter at this time no injection of auxiliary weakening air is being provided through the auxiliary air supply port 33 by the auxiliary air supply device 35, the internal combustion engine 1 is running with a somewhat rich idling mixture, which is effective for preventing stumbling, misfiring, and stalling. Because the throttle valve 10 is in its so called first idling position as shown by solid lines in FIG. 2, the first vacuum take out port 48 is downstream of said throttle valve 10, and therefore substantial vacuum is present at said first vacuum take out port 48. This vacuum is transmitted, via the conduit 64, the electromagnetic switching valve 65, and via the conduit 67, to the diaphragm chamber 46 of the secondary air control valve 40. Thereby, the diaphragm of the secondary air control valve 40, and the valve rod 44 attached thereto and the valve element 43, are displaced upwards as seen in the figure, and the valve element 43 is displaced away from the valve port 42, thus opening the valve port 42 and thereby communicating the secondary air injection port 38 with the atmosphere, via the one way reed valve 41, the secondary air control valve 40 which is open, and the air intake device 39. Thereby, as explained previously, due to the exhaust pulsation effect, secondary air is sucked into the exhaust manifold 4 through the intake device 39, the secondary air control valve 40, the one way reed valve 41, and the secondary air injection port 38.

As in the case of the first preferred embodiment, the sizes of the various apertures and passages in this system are so tailored that at this time the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric. Therefore, the oxygen sensor 37 will continuously detect presence of oxygen in the exhaust gases within the exhaust manifold 4, and will continuously dispatch a signal representative thereof to the auxiliary air control device 36, which will therefore continuously supply such a signal to the auxiliary air supply device 35 as to cause it not to feed any auxiliary air into the inlet manifold 3 through the auxiliary air supply port 33, as mentioned before. During this operational condition, the excess air ratio of the exhaust gases within the exhaust manifold 4 and being fed into the three way catalytic converter 6 through the exhaust tube 5 is substantially over unity—in other words, the exhaust gases have surplus oxygen in them—and therefore the three way catalytic converter 6 is being operated substantially only as an oxidizing catalytic converter, eliminating HC and CO and other products of incomplete combustion in the exhaust gases of the internal combustion engine 1 by an oxidizing reaction, but not substantially operating in the reduction mode to eliminate NOx from the exhaust gases; however, since in this rich idling operational condition of the internal combustion engine 1 the production of NOx is quite low and is not a significant problem in practice, this will be quite acceptable.

Now, suppose that from this non idle up idling condition, wherein the throttle valve 10 is in its first idling position, the throttle valve 10 is opened up to a substantial degree and is maintained in this state for power delivery operation of the internal combustion engine 1. As soon as the throttle valve 10 is opened up, the high degree of inlet manifold vacuum present at the first vacuum take out port 48 drops to substantially zero. Very quickly this substantially atmospheric pressure is transmitted along the conduit 64, past the electromagnetic switching valve 65, and along the conduit 67 to the diaphragm chamber 46 of the secondary air control valve 40. Thereby, the diaphragm of the secondary air control valve 40, and the valve rod 44 attached thereto and the valve element 43, are displaced downwards as seen in the figure due to the biasing effect of the compression coil spring 47, and the valve element 43 is displaced towards and against the valve port 42, thus closing the valve port 42 and thereby breaking the communication of the secondary air injection port 38 with the atmosphere via the one way reed valve 41, the secondary air control valve 40, and the air intake device 39. Thereby the flow of secondary air into the exhaust manifold 4 through the intake device 39, the secondary air control valve 40, the one way reed valve 41, and the secondary air injection port 38 immediately ceases, and does not recommence while the internal combustion engine 1 is in the non idling operational condition.

In this condition, since the basic air-fuel mixture provided by the carburetor 2, in this power operating condition as well as in the idling operational condition, as explained above, is somewhat richer than stoichiometric, the internal combustion engine 1 will initially be running on a richer than stoichiometric mixture. However, as in the first preferred embodiment shown in FIG. 1 and described above, very quickly this will result in the excess oxygen present in the exhaust gases within the exhaust manifold 4 disappearing, and therefore the oxygen sensor 37 will cease to dispatch a signal representative of the presence of oxygen, and will start to dispatch a signal representative of absence of oxygen, to the auxiliary air control device 36. This auxiliary air control device 36 will therefore start to supply such a signal to the auxiliary air supply device 35 as to cause it to feed auxiliary air into the inlet manifold 3 through the auxiliary air supply port 33, by the intake pulsation effect, and this will weaken the air/fuel ratio of the air-fuel mixture being supplied to the internal combustion engine 1. In a per se well known manner, by feedback control of the auxiliary air supply device 35 performed by the auxiliary air control device 36, therefore, the air/fuel ratio of the air-fuel mixture provided to the internal combustion engine 1 is brought to be on average substantially the stoichiometric value, by addition of the proper amount of auxiliary air thereto through the auxiliary air supply port 33. When this substantially stoichiometric air/fuel ratio for the intake air-fuel mixture of the internal combustion engine 1 has been attained, then the excess air ratio of the exhaust gases in the exhaust manifold 4 and passed through the three way catalytic converter 6 will be approximately 1—i.e., these exhaust gases will be near the stoichiometric condition—and therefore the three way catalytic converter 6 will function properly and effectively in its three way catalytic mode of removing not only HC, CO, and other products of incomplete combustion from the exhaust gases by an oxidising reaction, but also of purifying the exhaust gases of NOx by a reducing reaction.

Thus, as has been explained above, in the case of non idle up operation, the transition between the idling mode of operation, wherein the internal combustion engine 1 is operated with an idling air-fuel mixture substantially richer than stoichiometric and the three way catalytic converter 6 is operated substantially only in its oxidizing mode of operation and no auxiliary air is supplied through the auxiliary air supply port 33 while secondary air is supplied through the secondary air injection port 38, and the non idling mode of operation, wherein the internal combustion engine 1 is operated with an air-fuel mixture substantially stoichiometric and the three way catalytic converter 6 is operated in both its oxidizing mode of operation and its reducing mode of operation and auxiliary air is supplied through the auxiliary air supply port 33 while no secondary air is supplied through the secondary air injection port 38, is performed quickly, reliably, and simply, according to the function of the shown second preferred embodiment of the air/fuel ratio control system according to the present invention, as well as according to the function of the previously shown first embodiment.

Idle Up Operation

Now, on the other hand, suppose that based upon the output signals from the air conditioner compressor switch 60 and/or the power steering pump switch 61, etc., the idle up control device 59 is deciding that idle up action needs to be provided for the internal combustion engine 1, and accordingly the idle up control device 59 is providing actuating electrical energy for the electromagnetic switching valve 65 and for the solenoid device 62. In this condition, the port a of the electromagnetic switching valve 65 is communicated to the port b thereof, while the port c is not communicated to anything. Therefore in this idle up condition any vacuum which is present at the second vacuum take out port 49 is transmitted via the conduit 66, the electromagnetic switching valve 65, and the conduit 67 to the diaphragm chamber 46 of the diaphragm device 45 of the sedondary air control valve 40. Further, actuating electrical energy is provided to the solenoid device 62 by the idle up control device 59, and thus the rod 32 is displaced by said solenoid device 62 in the upwards direction as seen in FIG. 2, and therefore an idle up effect is provided for the throttle valve 10, as explained previously; in other words, the maximum closed position of the throttle valve 10 in this condition is its so called second idling or idle up position as shown by the phantom lines in FIG. 2, wherein the first vacuum take out port 48 is in fact upstream of said throttle valve 10, but the second vacuum take out port 49 is just downstream of said throttle valve 10. Further, in this idle up condition any vacuum which is present at the second vacuum take out port 49 is transmitted, via the conduit 66, the electromagnetic switching valve 65, and the conduit 67, to the diaphragm chamber 46 of the diaphragm device 45 of the secondary air control valve 40.

First, let us consider the case of idling operation at this idle up time, when the throttle valve 10 is in its so called idling position as shown by the phantom lines in FIG. 2. As has been previously mentioned, the carburetor 2 is designed to deliver a basically richer mixture than stoichiometric, and hence, since as will be seen hereinafter at this time no injection of auxiliary weakening air is being provided through the auxiliary air supply port 33 by the auxiliary air supply device 35, the internal combustion engine 1 is running with a somewhat rich idling mixture, which is effective for preventing stumbling, misfiring, and stalling. Because the throttle valve 10 is in its so called second idling position as shown by phantom lines in FIG. 2, the second vacuum take out port 49 is downstream of said throttle valve 10, and therefore substantial vacuum is present at said second vacuum take out port 49. The vacuum is transmitted, via the conduit 66, the electromagnetic switching valve 65 whose ports a and b are as stated above communicated to one another at this time, and via the conduit 67, to the diaphragm chamber 46 of the secondary air control valve 40. Thereby, the diaphragm of the secondary air control valve 40, and the valve rod 44 attached thereto and the valve element 43, are displaced upwards as seen in the figure, and the valve element 43 is displaced away from the valve port 42, thus opening the valve port 42 and thereby communicating the secondary air injection port 38 with the atmosphere, via the one way reed valve 41, the secondary air control valve 40 which is open, and the air intake device 39. Thereby, as explained previously, due to the exhaust pulsation effect, secondary air is sucked into the exhaust manifold 4 through the intake device 39, the secondary air control valve 40, the one way reed valve 41, and the secondary air injection port 38.

As has also been previously stated, the sizes of the various apertures and passages in this system are so tailored that at this time the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric. Therefore, the oxygen sensor 37 will continuously detect presence of oxygen in the exhaust gases within the exhaust manifold 4, and will continuously dispatch a signal representative thereof to the auxiliary air control device 36, which will therefore continuously supply such a signal to the auxiliary air supply device 35 as to cause it not to feed any auxiliary air into the inlet manifold 3 through the auxiliary air supply port 33, as mentioned above. Further, during this operational condition, the excess air ratio of the exhaust gases within the exhaust manifold 4 and being fed into the three way catalytic converter 6 through the exhaust tube 5 is substantially over unity—in other words, the exhaust gases have surplus oxygen in them—and therefore the three way catalytic converter 6 is being operated substantially only as an oxidizing catalytic converter, eliminating HC and CO and other products of incomplete combustion in the exhaust gases of the internal combustion engine 1 by an oxidizing reaction, but not substantially operating in the reduction mode to eliminate NOx from the exhaust gases; however, since in this rich idle up idling operational condition of the internal combustion engine 1 the production of NOx is quite low and is not a significant problem in practice, this will be quite acceptable.

Now, suppose that from this idle up idling condition, wherein the throttle valve 10 is in its second or idle up idling position, the throttle valve 10 is opened up to a substantial degree and is maintained in this state for power delivery operation of the internal combustion engine 1. As soon as the throttle valve 10 is opened up, the high degree of inlet manifold vacuum present at the second vacuum take out port 49 drops to substantially zero. Very quickly this substantially atmospheric pressure is transmitted via the conduit 66, the electromagnetic switching valve 65, and the conduit 67 to the diaphragm chamber 46 of the secondary air control valve 40. Thereby, the diaphragm of the secondary air control valve 40, and the valve rod 44 attached thereto and the valve element 43, are displaced downwards as seen in the figure due to the biasing effect of the compression coil spring 47, and the valve element 43 is displaced towards and against the valve port 42, thus closing the valve port 42 and thereby breaking the communication of the secondary air injection port 38 with the atmosphere via the one way reed valve 41, the secondary air control valve 40, and the air intake device 39. Thereby the flow of secondary air into the exhaust manifold 4 through the intake device 39, the secondary air control valve 40, the one way reed valve 41, and the secondary air injection port 38 immediately ceases, and does not recommence while the internal combustion engine 1 is in the non idling operational condition.

In this condition, since the basic air-fuel mixture provided by the carburetor 2, in this power operating condition as well as in the idle up idling operational condition, as explained above, is somewhat richer than stoichiometric, the internal combustion engine 1 will initially be running on a richer than stoichiometric mixture. However, very quickly this will result in the excess oxygen present in the exhaust gases within the exhaust manifold 4 disappearing, and therefore the oxygen sensor 37 will cease to dispatch a signal representative of the presence of oxygen, and will start to dispatch a signal representative of absence of oxygen, to the auxiliary air control device 36. This auxiliary air control device 36 will therefore start to supply such a signal to the auxiliary air supply device 35 as to cause it to feed, by the intake pulsation effect, auxiliary air into the inlet manifold 3 through the auxiliary air supply port 33, and this will weaken the air/fuel ratio of the air-fuel mixture being supplied to the internal combustion engine 1. In a per se well known manner, by feedback control of the auxiliary air supply device 35 performed by the auxiliary air control device 36, therefore, the air/fuel ratio of the air-fuel mixture provided to the internal combustion engine 1 is brought to be substantially the stoichiometric value, by addition of the proper amount of auxiliary air thereto through the auxiliary air supply port 33. When this substantially stoichiometric air/fuel ratio for the intake gases of the internal combustion engine 1 has been attained, then the excess air ratio of the exhaust gases in the exhaust manifold 4 and passed through the three way catalytic converter 6 will be approximately 1—i.e., these exhaust gases will be near the stoichiometric condition—and therefore the three way catalytic converter 6 will function properly and effectively in its three way catalytic mode of removing not only HC, CO, and other products of incomplete combustion from the exhaust gases by an oxidising reaction, but also of purifying the exhaust gases of NOx by a reducing reaction.

Thus, as has been explained above, in the case of idle up operation, the transition between the idle up idling mode of operation, wherein the internal combustion engine 1 is operated with an idle up idling air-fuel mixture substantially richer than stoichiometric and the three way catalytic converter 6 is operated substantially only in its oxidizing mode of operation and no auxiliary air is supplied through the auxiliary air supply port 33 while secondary air is supplied through the secondary air injection port 38, and the non idling mode of operation, wherein the internal combustion engine 1 is operated with an air-fuel mixture substantially stoichiometric and the three way catalytic converter 6 is operated in both its oxidizing mode of operation and its reducing mode of operation and auxiliary air is supplied through the auxiliary air supply port 33 while no secondary air is supplied through the secondary air injection port 38, is performed quickly, reliably, and simply, according to the function of the shown second preferred embodiment of the air/fuel ratio control system according to the present invention.

In summary, as will be clear from the above, in the operation of the shown second preferred embodiment of the air/fuel ratio control system according to the present invention, as well as in the function of the first preferred embodiment, in both the non idle up mode of operation thereof, and the idle up mode of operation thereof: when the throttle valve 10 is in its idling position (respectively either the non idle up idling position or the idle up idling position) then the internal combustion engine 1 is operated with an air-fuel mixture with an air/fuel ratio which is substantially richer than the stoichiometric one, which is effective for preventing stumbling, misfiring, and stalling of said internal combustion engine 1 during idling; while, on the other hand, when the throttle valve 10 is moved away from its idling position (whichever of the above non idle up or idle up idling positions said idling position may respectively currently be) by even a small amount, then the internal combustion engine 1 is operated with an air-fuel mixture with an air/fuel ratio which is substantially stoichiometric, which is effective for promoting proper operation of the three way catalytic converter 6 in its three way operational mode.

Construction of the Third Preferred Embodiment

Figure 3:
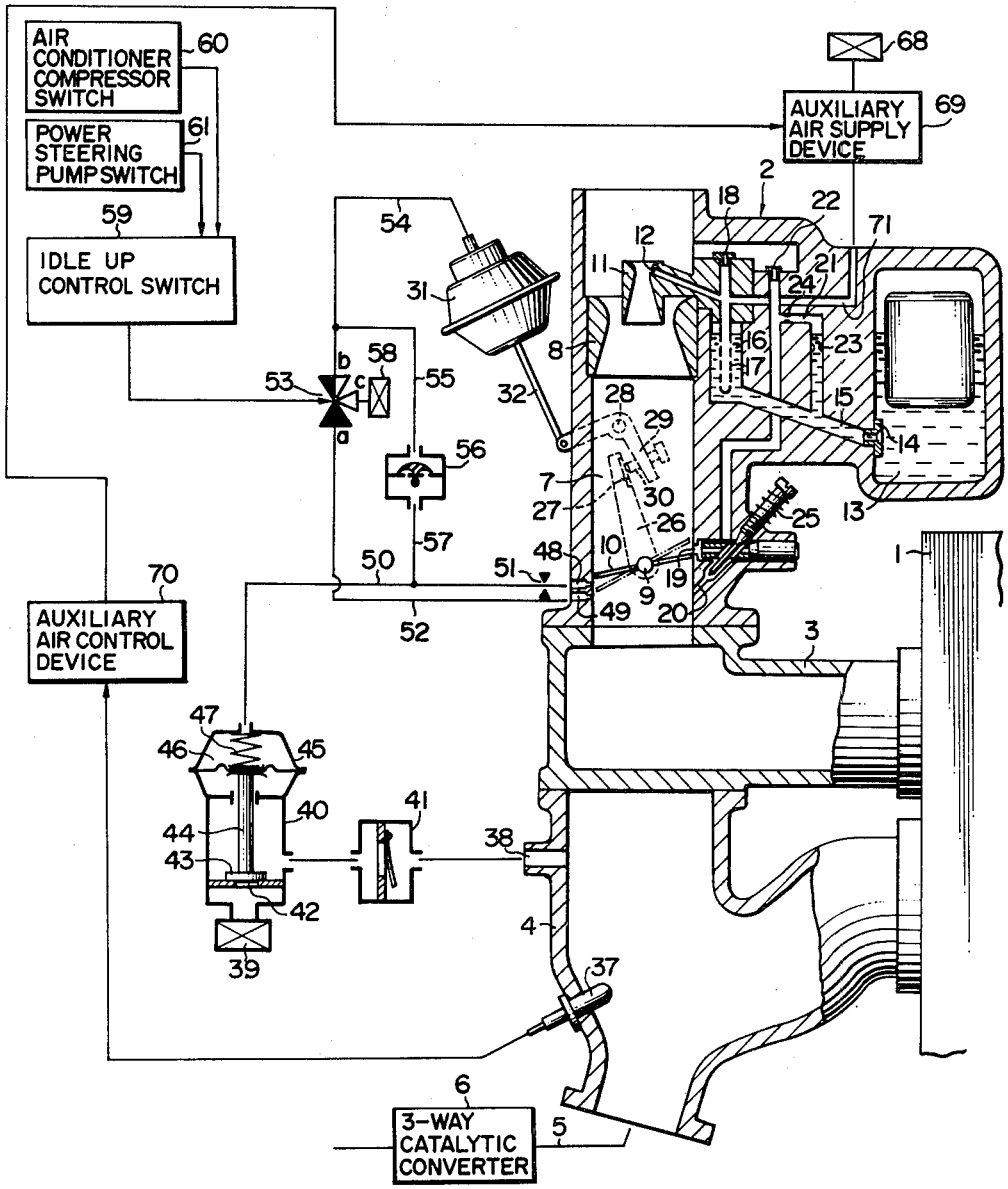
FIG. 3 is a part sectional part schematic constructional view, similar to FIGS. 1 and 2, partially showing an internal combustion engine and the intake and exhaust systems thereof, and also showing in detail an air/fuel ratio control system which is a third preferred embodiment of the present invention as fitted to this internal combustion engine.

In FIG. 3, there is shown a third preferred embodiment of the air/fuel ratio control system according to the present invention, in a fashion similar to FIG. 1 and FIG. 2. In FIG. 3, parts of the third preferred embodiment shown, which correspond to parts of the first and second preferred embodiments shown in FIG. 1 and in FIG. 2, and which have the same functions, are designated by the same reference numerals and symbols as in those figures.

In this figure, there is shown an internal combustion engine 1 which is equipped with the third preferred embodiment of the air/fuel ratio control system according to the present invention, and also there are shown various other control mechanisms associated therewith. As in the previously shown first and second embodiments, the reference numeral 2 denotes a carburetor which supplies fuel/air mixture to said internal combustion engine 1 through an intake manifold 3. The fuel/air mixture is combusted in the combustion chambers, not shown, of the internal combustion engine 1, and the exhaust gases resulting from this combustion are exhausted through an exhaust manifold 4 into an exhaust tube 5, at an intermediate part of which there is fitted a three-way catalytic converter 6 of a per se well known sort; the exhaust tube 5 and the three-way catalytic converter 6 are only shown schematically in FIG. 3, because the details of their construction are not relevant.

The construction of the carburetor 2 will now be described. This carburetor 2 is different from the carburetor 2 used with the first and second preferred embodiments described above, because of additional air bleeding arrangements provided thereto, as will be seen later. An air passage or throat 7 is formed through the body of the carburetor 2, and a large venturi 8 is fitted at an upstream position in this throat 7. Downstream of the large venturi 8 within the carburetor throat 7 there is fitted a butterfly type throttle valve 10, which is fixed to a throttle shaft 9 which is rotatably mounted in the walls of the throat 7, and which can rotate between a position as seen in solid lines in the figure in which it almost completely interrupts flow of gas through the throat 7, and a position in which it is quite wide open. Within the large venturi 8 there is fitted a small venturi 11, and within the small venturi 11 a main fuel nozzle 12 opens.

The carburetor 2 is provided with a float chamber 13, and liquid fuel such as gasoline is kept at a predetermined constant level within this float chamber by a float and valve mechanism, not particularly shown or described here. Via a main fuel jet 14, this fuel flows from the float chamber 13 into a main fuel passage 15, which leads it to a well 16. In the well 16 there is provided an air bleed tube 17 which is pierced with a plurality of small holes for admitting a constant basic quantity of bleed air into the liquid fuel within the well 16 from the atmosphere, via a main air bleed jet 18, in a per se conventional manner.

To the air bleed tube 17, at an intermediate point thereof, there opens an auxiliary air bleed tube 71, which leads as will be explained later to the output side of an auxiliary air supply device 69, the input side of which is communicated to atmosphere via a clean air supply assembly 68. According therefore as more or less extra or auxiliary bleed air is admitted by the auxiliary air supply device 69 into the auxiliary air bleed tube 71, so more or less total bleed air is mixed with the liquid fuel such as gasoline in the well 16, from the holes in the air bleed tube 17.

The body of the carburetor 2 is further provided with a slow port 19 and an idle port 20, which are communicated with one another. A part of the fuel flowing through the main fuel passage 15 is diverted into a slow fuel passage 21, which leads to the slow port 19 and the idle port 20. At an intermediate part of the slow fuel passage 21 there opens a passage which leads to the atmosphere via a slow air bleed jet 22, and upstream of this intermediate part there are fitted within the slow fuel passage 21 a slow fuel jet 23 and an economizer jet 24. Finally, the amount of fuel which is supplied into the throat 7 of the carburetor 2 from the idle port 20 is controlled by an idle adjust screw 25, whose pointed end coapts with the idle port 20 to form a metering orifice.

The general construction of the carburetor 2, and of the various passages and jets therein, is that, provided no auxiliary bleed air is admitted into the auxiliary air bleed tube 71, the carburetor 2 tends to supply an air-fuel mixture whose air/fuel ratio is less than the stoichiometric ratio; in other words, a rich air-fuel mixture, both in the idling operational condition and in the non-idling operational condition wherein the throttle valve 10 is significantly opened.

Now the arrangements for performing so called "idle up" of the carburetor 2, which are in fact the same as in the first preferred embodiment, will be explained. Certain parts thereof are shown in FIG. 3 by dashed lines because they are in fact located outside the main body of the carburetor 2, behind the throat 7 from the point of view of the figure. To the throttle shaft 9 there is fixed a throttle lever 26, which extends upwards in the figure, and the upper end of which is formed with a lug 27. An idle up lever 29 of a generally L shape is pivotally attached to the body of the carburetor 2 by a pivot pin 28, and an adjusting screw 30 fitted in the end of one arm of this idle up lever 29 abuts against the lug 27. In this first shown constructional example, the end of the other arm of the idle up lever 29 is connected, via a rod 32, to the diaphragm (not particularly shown) of a diaphragm device 31, whose body is fixed to the body of the carburetor 2, although this is not shown in the figure.

Thus, when the diaphragm chamber (not shown) of the diaphragm device 31 is not supplied with vacuum, then the idle up lever 29 and the adjusting screw 30 are in their positions as shown by dashed lines in the figure, and in this condition when the accelerator pedal (not shown) or other actuating means for the throttle valve 10 is released this throttle valve 10 can return to its so called first idling position as shown by solid lines in FIG. 3, with the lug 29 abutting against the adjusting screw 30 which is in its shown position. On the other hand, when the diaphragm chamber (not shown) of the diaphragm device 31 is supplied with vacuum, then the idle up lever 29 and the adjusting screw 30 are moved, via the rod 32, somewhat in the clockwise direction from their positions as shown by dashed lines in the figure, and in this condition when the accelerator pedal (not shown) or other actuating means for the throttle valve 10 is released this throttle valve 10 can only return to its position as shown by phantom lines in FIG. 3, with the lug 29 abutting against the adjusting screw 30 in its new idle up position, somewhat to the left in FIG. 3 from its shown position. In other words, the throttle valve 10 can only return to a so called second idling or idle up position wherein said throttle valve 10 is a little opened up from said first idling position and therefore provides somewhat more idling fuel-air mixture for the internal combustion engine 1 than would be provided in said first idling position.

In this third preferred embodiment, the means provided for weakening the basically rich air-fuel mixture provided by the carburetor 2, as partly outlined above, are as follows. The auxiliary air bleed tube 71 in the carburetor 2 is connected to the output side of an auxiliary air supply device 69, the input side of which is connected to a clean air supply assembly 68 which may include an air filter and the like. The auxiliary air supply device 69 comprises a valve device for metering the amount of air flowing therethrough, and is itself per se well known. The auxiliary air supply device 69 is controlled by an auxiliary air control device 70, which receives a signal from an oxygen sensor 37 mounted in the exhaust manifold 4. When and only when the oxygen sensor 37 detects no oxygen in the exhaust gases flowing through the exhaust manifold 4, the auxiliary air supply device 69 is activated to feed air into the auxiliary air bleed tube 71.

The arrangements for providing secondary air to the exhaust manifold 4, which are exactly the same as in the first preferred embodiment described above, will now be explained. Within the exhaust manifold 4 there is provided a secondary air injection port 38. This secondary air injection port 38 is located upstream of the oxygen sensor 37, so that when secondary air is being injected through the port 38 said oxygen sensor 37 is responding to the oxygen content of exhaust gases into which said air has been injected. Air is provided to the secondary air injection port 38, via a one way reed valve 41 of a per se well known construction, through and under the control of a secondary air control valve 40, which takes in this air from the atmosphere via an air intake device 39 which may incorporate an air filter. When the secondary air control valve 40 is opened, secondary air is sucked into the exhaust manifold 4 by the exhaust pulsation effect. The sizes of the various apertures and passages in this system are in this third preferred embodiment also so tailored that, when the internal combustion engine 1 is idling and the secondary air control valve 40 is open, the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric.

The details of the internal construction of the secondary air control valve 40 in this third preferred embodiment are exactly the same as those of the secondary air control valve 40 shown with regard to the description of the first preferred embodiment of the air/fuel ratio control system according to the present invention, and hence explanation thereof is omitted here in order to avoid redundancy of description. Now the arrangements (which are also the same as in the first preferred embodiment described above) for providing actuating vacuum for the diaphragm device 31 which performs the idle up of the carburetor 2 and for the diaphragm device 45 of the secondary air control valve 40 will be described.

Two vacuum take out ports 48 and 49 are provided in the throat 7 of the carburetor 2, near the trailing edge of the throttle valve 10. The first vacuum take out port 48 is so located that it is downstream of the throttle valve 10 when the throttle valve 10 is in its first idling position, and becomes to be upstream of the throttle valve 10 when the throttle valve 10 is opened slightly beyond its first idling position. On the other hand, the second vacuum take out port 49 is so located that it is downstream of the throttle valve 10 when the throttle valve 10 is in its second idling position or idle up position, and becomes to be upstream of the throttle valve 10 when the throttle valve 10 is opened slightly beyond its second idling or idle up position. Thus, in fact, the second vacuum take out port 49 is located very close to, but a little downstream of, the first vacuum take out port 48.

The first vacuum take out port 48 is connected via a conduit 50 to the diaphragm chamber 46 of the diaphragm device 45, and a throttling element 51 is interposed at an upstream part of the conduit 50. The second vacuum take out port 49 is connected via a conduit 52 to a port a of an electromagnetic vacuum switching valve 53.

The electromagnetic vacuum switching valve 53 has three ports a, b, and c. When actuating electrical energy is not being supplied to the electromagnetic vacuum switching valve 53, then the port b thereof is communicated to the port c thereof, while the port a is not communicated to anything; and, on the other hand, when actuating electrical energy is being supplied to the electromagnetic vacuum switching valve 53, then the port b thereof is communicated to the port a thereof, while the port c is not communicated to anything.

The port c of the electromagnetic vacuum switching valve 53 is communicated to the atmosphere via an air intake device 58 which may incorporate an air filter, and the port b of the electromagnetic vacuum switching valve 53 is communicated directly, via a conduit 54, to the diaphragm chamber of the diaphragm device 31, and is also communicated, via a conduit 55, a one way valve 56, and a conduit 57, in that order, to a part of the conduit 50 downstream of the throttling element 51, i.e. on the side of the throttling element 51 towards the secondary air control valve 40. The one way valve 56 is so constructed that it will only allow fluid to flow therethrough in the direction from the conduit 57 towards the conduit 55, and not vice versa; i.e., so that it will only allow vacuum to flow in the opposite direction.

Actuating electrical energy is selectively supplied to the electromagnetic vacuum switching valve 53 by an idle up control device 59 of a per se well known sort, which receives input signals from an air conditioner compressor switch 60 and/or from a power steering pump switch 61, or the like, which depending upon these input signals decides when idle up of the internal combustion engine 1 should be performed, and which when it so decides supplies actuating electrical energy to the electromagnetic vacuum switching valve 53.

Operation of the Third Preferred Embodiment

Now the operation of this first preferred embodiment of the air/fuel ratio control system according to the present invention will be explained.

Non Idle Up Operation

First, suppose that based upon the output signals from the air conditioner compressor switch 60 and/or the power steering pump switch 61, etc., the idle up control device 59 is deciding that no idle up action needs to be provided for the internal combustion engine 1, and accordingly the idle up control device 59 is not providing any actuating electrical energy for the electromagnetic switching valve 53. In this condition, the port b of the electromagnetic switching valve 53 is communicated to the port c thereof and therethrough to atmosphere, while the port a is not communicated to anything, and therefore atmospheric pressure is admitted to the diaphragm chamber of the diaphragm device 31 (but is not admitted to the conduit 50 via the conduit 57, due to the provision of the one way valve 56 which intercepts air flow in this direction). Thus the rod 32 is not displaced by said diaphragm device 31 in the upwards direction as seen in FIG. 3, and therefore no idle up effect is provided for the throttle valve 10, as explained above; in other words, the maximum closed position of the throttle valve 10 in this condition is its so called first idling position as shown by solid lines in FIG. 3, wherein the first vacuum take out port 48 is downstream of said throttle valve 10. Further, in this non idle up condition any vacuum which is present at the first vacuum take out port 48 is transmitted, via the throttling element 51 which delays its transmission for a short time, to the diaphragm chamber 46 of the diaphragm device 45 of the secondary air control valve 40.

First, let us consider the case of idling operation at this non idle up time, when the throttle valve 10 is in its so called first idling position as shown by solid lines in FIG. 3. As has been previously mentioned, the carburetor 2 is designed to deliver a basically richer mixture than stoichiometric, and hence, since as will be seen hereinafter at this time no injection of auxiliary weakening bleed air is being provided through the auxiliary air bleed tube 71 by the auxiliary air supply device 69, the internal combustion engine 1 is running with a somewhat rich idling mixture, which is effective for preventing stumbling, misfiring, and stalling. Because the throttle valve 10 is in its so called first idling position as shown by solid lines in FIG. 3, the first vacuum take out port 48 is downstream of said throttle valve 10, and therefore substantial vacuum is present at said first vacuum take out port 48. This vacuum is transmitted, via the throttling element 51 which does not substantially disturb it, and via the conduit 50, to the diaphragm chamber 46 of the secondary air control valve 40. Thereby, the diaphragm of the secondary air control valve 40, and the valve rod 44 attached thereto and the valve element 43, are displaced upwards as seen in the figure, and the valve element 43 is displaced away from the valve port 42, thus opening the valve port 42 and thereby communicating the secondary air injection port 38 with the atmosphere, via the one way reed valve 41, the secondary air control valve 40 which is open, and the air intake device 39. Thereby, as explained previously, due to the exhaust pulsation effect, secondary air is sucked into the exhaust manifold 4 through the intake device 39, the secondary air control valve 40, the one way reed valve 41, and the secondary air injection port 38.

As has also been explained, the sizes of the various apertures and passages in this system are so tailored that at this time the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric. Therefore, the oxygen sensor 37 will continuously detect presence of oxygen in the exhaust gases within the exhaust manifold 4, and will continuously dispatch a signal representative thereof to the auxiliary air control device 70, which will therefore continuously supply such a signal to the auxiliary air supply device 69 as to cause it not to feed any auxiliary air into the intake system of the internal combustion engine 1 through the auxiliary air bleed tube 71, as mentioned above. Further, during this operational condition, the excess air ratio of the exhaust gases within the exhaust manifold 4 and being fed into the three way catalytic converter 6 through the exhaust tube 5 is substantially over unity—in other words, the exhaust gases have surplus oxygen in them—and therefore the three way catalytic converter 6 is being operated substantially only as an oxidizing catalytic converter, eliminating HC and CO and other products of incomplete combustion in the exhaust gases of the internal combustion engine 1 by an oxidizing reaction, but not substantially operating in the reduction mode to eliminate NOx from the exhaust gases; however, since in this rich idling operational condition of the internal combustion engine 1 the production of NOx is quite low and is not a significant problem in practice, this will be quite acceptable.

Now, suppose that from this non idle up idling condition, wherein the throttle valve 10 is in its first idling position, the throttle valve 10 is opened up to a substantial degree and is maintained in this state for power delivery operation of the internal combustion engine 1. As soon as the throttle valve 10 is opened up, the high degree of inlet manifold vacuum present at the first vacuum take out port 48 drops to substantially zero. Very quickly this substantially atmospheric pressure is transmitted past the throttling element 51 along the conduit 50 to the diaphragm chamber 46 of the secondary air control valve 40. Thereby, the diaphragm of the secondary air control valve 40, and the valve rod 44 attached thereto and the valve element 43, are displaced downwards as seen in the figure due to the biasing effect of the compression coil spring 47, and the valve element 43 is displaced towards and against the valve port 42, thus closing the valve port 42 and thereby breaking the communication of the secondary air injection port 38 with the atmosphere via the one way reed valve 41, the secondary air control valve 40, and the air intake device 39. Thereby the flow of secondary air into the exhaust manifold 4 through the intake device 39, the secondary air control valve 40, the one way reed valve 41, and the secondary air injection port 38 immediately ceases, and does not recommence while the internal combustion engine 1 is in the non idling operational condition.

In this condition, since the basic air-fuel mixture provided by the carburetor 2, in this power operating condition as well as in the idling operational condition, as explained above, is somewhat richer than stoichiometric, the internal combustion engine 1 will initially be running on a richer than stoichiometric mixture. However, very quickly this will result in the excess oxygen present in the exhaust gases within the exhaust manifold 4 disappearing, and therefore the oxygen sensor 37 will cease to dispatch a signal representative of the presence of oxygen, and will start to dispatch a signal representative of absence of oxygen, to the auxiliary air control device 70. This auxiliary air control device 70 will therefore start to supply such a signal to the auxiliary air supply device 69 as to cause it to feed auxiliary air into the fuel in the well 16 through the auxiliary air bleed tube 71, and this will weaken the air/fuel ratio of the air-fuel mixture being supplied to the internal combustion engine 1. In a per se well known manner, by feedback control of the auxiliary air supply device 69 performed by the auxiliary air control device 70, therefore, the air/fuel ratio of the air-fuel mixture provided to the internal combustion engine 1 is brought to be substantially the stoichiometric value, by addition of the proper amount of auxiliary air thereto through the auxiliary air bleed tube 71. When this substantially stoichiometric air/fuel ratio for the intake gases of the internal combustion engine 1 has been attained, then the excess air ratio of the exhaust gases in the exhaust manifold 4 and passed through the three way catalytic converter 6 will be approximately 1—i.e., these exhaust gases will be near the stoichiometric condition—and therefore the three way catalytic converter 6 will function properly and effectively in its three way catalytic mode of removing not only HC, CO, and other products of incomplete combustion from the exhaust gases by an oxidising reaction, but also of purifying the exhaust gases of NOx by a reducing reaction.

Thus, as has been explained above, in the case of non idle up operation, the transition between the idling mode of operation, wherein the internal combustion engine 1 is operated with an idling air-fuel mixture substantially richer than stoichiometric and the three way catalytic converter 6 is operated substantially only in its oxidizing mode of operation and no auxiliary air is supplied through the auxiliary air bleed tube 71 while secondary air is supplied through the secondary air injection port 38, and the non idling mode of operation, wherein the internal combustion engine 1 is operated with an air-fuel mixture substantially stoichiometric and the three way catalytic converter 6 is operated in both its oxidizing mode of operation and its reducing mode of operation and auxiliary air is supplied through the auxiliary air bleed tube 71 while no secondary air is supplied through the secondary air injection port 38, is performed quickly, reliably, and simply, according to the function of the shown third preferred embodiment of the air/fuel ratio control system according to the present invention.

Idle Up Operation

Now, on the other hand, suppose that based upon the output signals from the air conditioner compressor switch 60 and/or the power steering pump switch 61, etc., the idle up control device 59 is deciding that idle up action needs to be provided for the internal combustion engine 1, and accordingly the idle up control device 59 is providing actuating electrical energy for the electromagnetic switching valve 53. In this condition, the port a of the electromagnetic switching valve 53 is communicated to the port b thereof, while the port c is not communicated to anything. Therefore, when the throttle pedal or other throttle actuating device of the vehicle incorporating this system is released, so as to close the throttle valve 10, the high amount of vacuum which is immediately thus caused to be present at the second vacuum take out port 49 is transmitted, via the vacuum conduit 52, to the port a of the electromagnetic switching valve 53, whence this vacuum is transmitted to the diaphragm chamber of the diaphragm device 31 and actuates the diaphragm (not shown) thereof. Thus the rod 32 is displaced by said diaphragm device 31 in the upwards direction as seen in FIG. 3, and therefore an idle up effect is provided for the throttle valve 10, as explained previously; in other words, the maximum closed position of the throttle valve 10 in this condition is its so called second idling or idle up position as shown by the phantom lines in FIG. 3, wherein the first vacuum take out port 48 is in fact upstream of said throttle valve 10, but the second vacuum take out port 49 is just downstream of said throttle valve 10. Further, in this idle up condition any vacuum which is present at the second vacuum take out port 49 is transmitted, via the conduit 52, the electromagnetic switching valve 53, the conduit 54, the conduit 55, the one way valve 56, the conduit 57, and the conduit 50, to the diaphragm chamber 46 of the diaphragm device 45 of the secondary air control valve 40. In this connection, by the way, substantial escape of such vacuum through the upstream part of the conduit 50 in the reverse direction through the first vacuum take out port 48 is prevented by the provision of the throttling element 51.

First, let us consider the case of idling operation at this idle up time, when the throttle valve 10 is in its so called second idling position as shown by the phantom lines in FIG. 3. As has been previously mentioned, the carburetor 2 is designed to deliver a basically richer mixture than stoichiometric, and hence, since as will be seen hereinafter at this time no injection of auxiliary weakening bleed air is being provided through the auxiliary air bleed tube 71 by the auxiliary air supply device 69, the internal combustion engine 1 is running with a somewhat rich idling mixture, which is effective for preventing stumbling, misfiring, and stalling. Because the throttle valve 10 is in its so called second idling position as shown by phantom lines in FIG. 3, the second vacuum take out port 49 is downstream of said throttle valve 10, and therefore substantial vacuum is present at said second vacuum take out port 49. This vacuum is transmitted, via the conduit 52, the electromagnetic switching valve 53 whose ports a and b are as stated above communicated to one another at this time, via the conduits 54 and 55, via the one way valve 56, and via the conduits 57 and 50, to the diaphragm chamber 46 of the secondary air control valve 40 (not being substantially attenuated by leakage past the throttling element 51 to the first vacuum take out port 48, due to the high flow resistance of said throttling element 51). Thereby, the diaphragm of the secondary air control valve 40, and the valve rod 44 attached thereto and the valve element 43, are displaced upwards as seen in the figure, and the valve element 43 is displaced away from the valve port 42, thus opening the valve port 42 and thereby communicating the secondary air injection port 38 with the atmosphere, via the one way reed valve 41, the secondary air control valve 40 which is open, and the air intake device 39. Thereby, as explained previously, due to the exhaust pulsation effect, secondary air is sucked into the exhaust manifold 4 through the intake device 39, the secondary air control valve 40, the one way reed valve 41, and the secondary air injection port 38.

As has also been previously stated, the sizes of the various apertures and passages in this system are so tailored that at this time the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric. Therefore, the oxygen sensor 37 will continuously detect presence of oxygen in the exhaust gases within the exhaust manifold 4, and will continuously dispatch a signal representative thereof to the auxiliary air control device 70, which will therefore continuously supply such a signal to the auxiliary air supply device 69 as to cause it not to feed any auxiliary air into the inlet manifold 3 through the auxiliary air bleed tube 71, as mentioned above. Further, during this operational condition, the excess air ratio of the exhaust gases within the exhaust manifold 4 and being fed into the three way catalytic converter 6 through the exhaust tube 5 is substantially over unity—in other words, the exhaust gases have surplus oxygen in them—and therefore the three way catalytic converter 6 is being operated substantially only as an oxidizing catalytic converter, eliminating HC and CO and other products of incomplete combustion in the exhaust gases of the internal combustion engine 1 by an oxidizing reaction, but not substantially operating in the reduction mode to eliminate NOx from the exhaust gases; however, since in this rich idle up idling operational condition of the internal combustion engine 1 the production of NOx is quite low and is not a significant problem in practice, this will be quite acceptable.

Now, suppose that from this idle up idling condition, wherein the throttle valve 10 is in its second or idle up idling position, the throttle valve 10 is opened up to a substantial degree and is maintained in this state for power delivery operation of the internal combustion engine 1. As soon as the throttle valve 10 is opened up, the high degree of inlet manifold vacuum present at the second vacuum take out port 49 drops to substantially zero. Very quickly this substantially atmospheric pressure is transmitted via the conduit 52, the electromagnetic switching valve 53 whose ports a and b are communicated to one another at this time, via the conduits 54 and 55, via the one way valve 56, and via the conduits 57 and 50, to the diaphragm chamber 46 of the secondary air control valve 40. Thereby, the diaphragm of the secondary air control valve 40, and the valve rod 44 attached thereto and the valve element 43, are displaced downwards as seen in the figure due to the biasing effect of the compression coil spring 47, and the valve element 43 is displaced towards and against the valve port 42, thus closing the valve port 42 and thereby breaking the communication of the secondary air injection port 38 with the atmosphere via the one way reed valve 41, the secondary air control valve 40, and the air intake device 39. Thereby the flow of secondary air into the exhaust manifold 4 through the intake device 39, the secondary air control valve 40, the one way reed valve 41, and the secondary air injection port 38 immediately ceases, and does not recommence while the internal combustion engine 1 is in the non idling operational condition.

In this condition, since the basic air-fuel mixture provided by the carburetor 2, in this power operating condition as well as in the idle up idling operational condition, as explained above, is somewhat richer than stoichiometric, the internal combustion engine 1 will initially be running on a richer than stoichiometric mixture. However, very quickly this will result in the excess oxygen present in the exhaust gases within the exhaust manifold 4 disappearing, and therefore the oxygen sensor 37 will cease to dispatch a signal representative of the presence of oxygen, and will start to dispatch a signal representative of absence of oxygen, to the auxiliary air control device 70. This auxiliary air control device 70 will therefore start to supply such a signal to the auxiliary air supply device 69 as to cause it to feed auxiliary bleed air into the fuel within the well 16 through the auxiliary air bleed tube 71, and this will weaken the air/fuel ratio of the air-fuel mixture being supplied to the internal combustion engine 1. In a per se well known manner, by feedback control of the auxiliary air supply device 69 performed by the auxiliary air control device 70, therefore, the air/fuel ratio of the air-fuel mixture provided to the internal combustion engine 1 is brought to be substantially the stoichiometric value, by addition of the proper amount of auxiliary air thereto through the auxiliary air bleed tube 71. When this substantially stoichiometric air/fuel ratio for the intake gases of the internal combustion engine 1 has been attained, then the excess air ratio of the exhaust gases in the exhaust manifold 4 and passed through the three way catalytic converter 6 will be approximately 1—i.e., these exhaust gases will be near the stoichiometric condition—and therefore the three way catalytic converter 6 will function properly and effectively in its three way catalytic mode of removing not only HC, CO, and other products of incomplete combustion from the exhaust gases by an oxidising reaction, but also of purifying the exhaust gases of NOx by a reducing reaction.

Thus, as has been explained above, in the case of idle up operation, the transition between the idle up idling mode of operation, wherein the internal combustion engine 1 is operated with an idle up idling air-fuel mixture substantially richer than stoichiometric and the three way catalytic converter 6 is operated substantially only in its oxidizing mode of operation and no auxiliary air is supplied through the auxiliary air bleed tube 71 while secondary air is supplied through the secondary air injection port 38, and the non idling mode of operation, wherein the internal combustion engine 1 is operated with an air-fuel mixture substantially stoichiometric and the three way catalytic converter 6 is operated in both its oxidizing mode of opertion and its reducing mode of operation and auxiliary air is supplied through the auxiliary air bleed tube 71 while no secondary air is supplied through the secondary air injection port 38, is performed quickly, reliably, and simply, according to the function of the shown first preferred embodiment of the air/fuel ratio control system according to the present invention.

In summary, as will be clear from the above, in both the non idle up mode of operation of the shown third preferred embodiment of the air/fuel ratio control system according to the present invention, and the idle up mode of operation thereof: when the throttle valve 10 is in its idling position (respectively either the non idle up idling position or the idle up idling position) then the internal combustion engine 1 is operated with an air-fuel mixture with an air/fuel ratio which is substantially richer than the stoichiometric one, which is effective for preventing stumbling, misfiring, and stalling of said internal combustion engine 1 during idling; while, on the other hand, when the throttle valve 10 is moved away from its idling position (whichever of the above non idle up or idle up idling positions said idling position may respectively currently be) by even a small amount, then the internal combustion engine 1 is operated with an air-fuel mixture with an air/fuel ratio which is substantially stoichiometric, which is effective for promoting proper operation of the three way catalytic converter 6 in its three way operational mode.

Construction of the Fourth Preferred Embodiment

Figure 4:
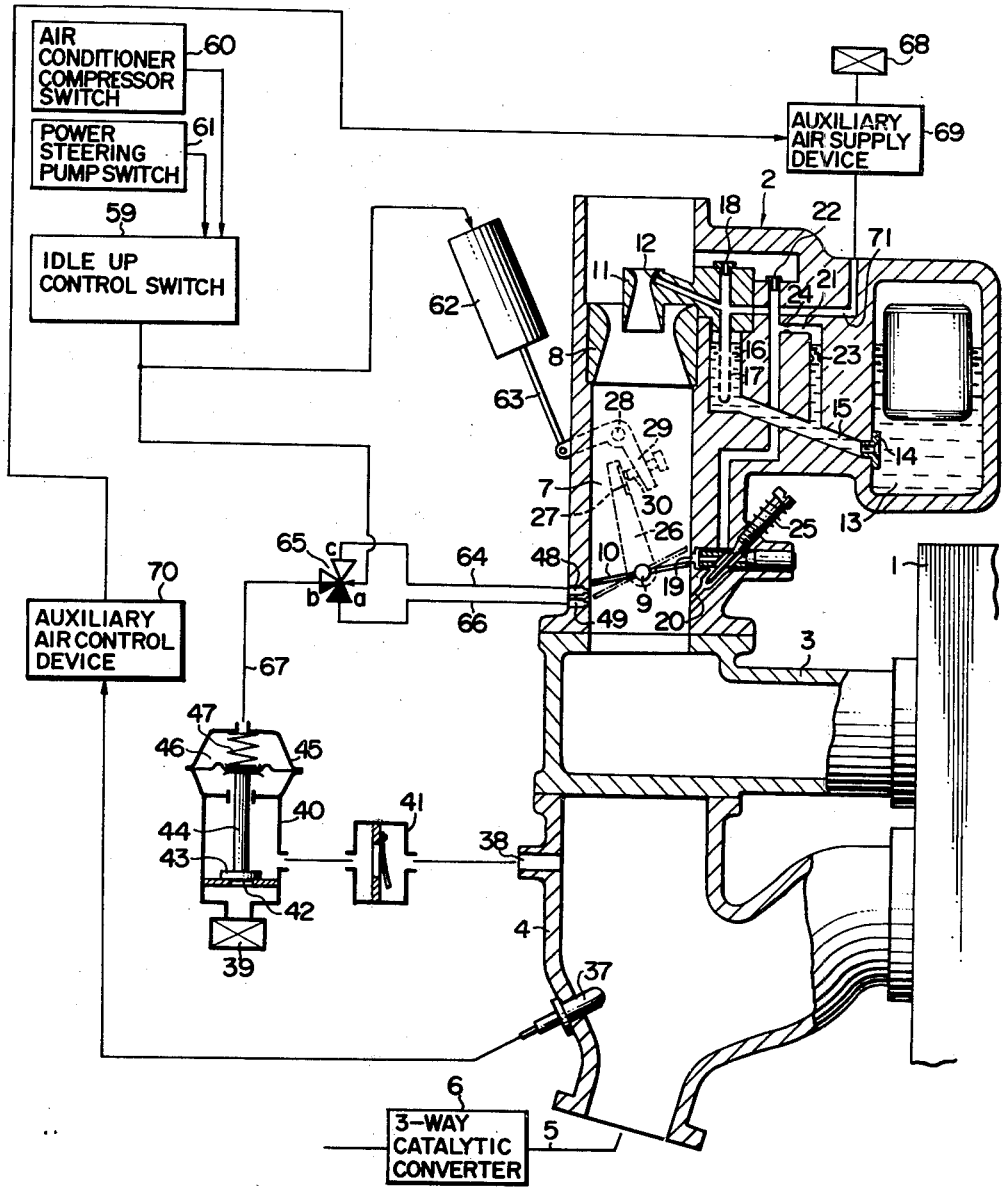
FIG. 4 is a part sectional part schematic constructional view, similar to FIGS. 1, 2, and 3, partially showing an internal combustion engine and the intake and exhaust systems thereof, and also showing in detail an air/fuel ratio control system which is a fourth preferred embodiment of the present invention as fitted to this internal combustion engine.

In FIG. 4, there is shown a fourth preferred embodiment of the air/fuel ratio control system according to the present invention, in a fashion similar to FIGS. 1–3. In FIG. 4, parts of the fourth preferred embodiment shown, which correspond to parts of the first through third preferred embodiments shown in FIGS. 1–3, and which have the same functions, are designated by the same reference numerals and symbols as in those figures.

In FIG. 4, there is again shown an internal combustion engine 1, which is now equipped with a fourth preferred embodiment of the air/fuel ratio control system according to the present invention. This fourth preferred embodiment, in its difference from the first preferred embodiment, combines the features of the second and of the third preferred embodiments.

The reference numeral 2 again denotes a carburetor which supplies fuel/air mixture to said internal combustion engine 1 through an intake manifold 3. The fuel/air mixture is combusted in the combustion chambers, not shown, of the internal combustion engine 1, and the exhaust gases resulting from this combustion are again exhausted through an exhaust manifold 4 into an exhaust tube 5, at an intermediate part of which there is again fitted a three-way catalytic converter 6 of a per se well known sort; the exhaust tube 5 and the three-way catalytic converter 6 are again only shown schematically in FIG. 2, because the details of their construction are not relevant.

The details of the internal construction of the carburetor 2 are exactly the same as those of the carburetor 2 shown with regard to the description of the third preferred embodiment of the air/fuel ratio control system according to the present invention, incorporating an auxiliary bleed air tube 71, and hence explanation thereof is omitted here in order to avoid redundancy of description. The general construction of the carburetor 2, and of the various passages and jets therein, again with regard to this second preferred embodiment, is that the carburetor 2 tends to supply an air-fuel mixture whose air/fuel ratio is less than the stoichiometric ratio, when no extra bleed air is being admitted through the auxiliary bleed air tube 71; in other words, a rich air-fuel mixture, both in the idling operational condition and in the non-idling operational condition wherein the throttle valve 10 is significantly opened.

Now the arrangements for performing so called "idle up" of the carburetor 2 will be explained, which are in this case the same as in the case of the second preferred embodiment. As before, certain parts thereof are shown in FIG. 2 by dashed lines because they are in fact located outside the main body of the carburetor 2, behind the throat 7 from the point of view of the figure. To the throttle shaft 9 there is fixed a throttle lever 26, which extends upwards in the figure, and the upper end of which is fomed with a lug 27. An idle up lever 29 of a generally L shape is pivotally attached to the body of the carburetor 2 by a pivot pin 28, and an adjusting screw 30 fitted in the end of one arm of this idle up lever 29 abuts against the lug 27. In this construction, the end of the other arm of the idle up lever 29 is connected to the plunger 63 of a solenoid device 62, whose body is fixed to the body of the carburetor 2, although this is not shown in the figure.

Thus, when the coil (not shown) of the solenoid device 62 is not supplied with actuating electrical energy, then the idle up lever 29 and the adjusting screw 30 are in their positions as shown by dashed lines in the figure, and in this condition when the accelerator pedal (not shown) or other actuating means for the throttle valve 10 is released this throttle valve 10 can return to its so called first idling position as shown by solid lines in FIG. 4, with the lug 29 abutting against the adjusting screw 30 which is in its shown position. On the other hand, when the coil (not shown) of the solenoid device 62 is supplied with actuating electrical energy, then the idle up lever 29 and the adjusting screw 30 are moved, via the rod 32, somewhat in the clockwise direction from their positions as shown by dashed lines in the figure, and in this condition when the accelerator pedal (not shown) or other actuating means for the throttle valve 10 is released this throttle valve 10 can only return to its position as shown by phantom lines in FIG. 4, with the lug 29 abutting against the adjusting screw 30 in its new idle up position, somewhat to the left in FIG. 4 from its shown position. In other words, the throttle valve 10 can only return to a so called second idling or idle up position wherein said throttle valve 10 is a little opened up from said first idling position and therefore provides somewhat more idling fuel-air mixture for the internal combustion engine 1 than would be provided in said first idling position.

In this fourth preferred embodiment, the construction of the system for selectively providing auxiliary air into the intake system of the internal combustion engine 1, in order to weaken the somewhat richer than stoichiometric air-fuel mixture which is being provided by the carburetor 2, comprising the auxiliary air bleed tube 71, the auxiliary air supply device 69, the clean air supply assembly 68, the auxiliary air control device 70, and the oxygen sensor 37, is exactly the same as in the third preferred embodiment of the air/fuel ratio control device according to the present invention shown in FIG. 3, and hence explanation thereof is omitted here in order to avoid redundancy of description.

Within the exhaust manifold 4 there is again provided a secondary air injection port 38, upstream of the oxygen sensor 37, which in exactly the same way as in the first through third preferred embodiments shown in FIGS. 1 through 3 is selectively provided with air via a one way reed valve 41 of a per se well known construction, through and under the control of a secondary air control valve 40, which takes in this air from the atmosphere via an air intake device 39 which may incorporate an air filter. When the secondary air control valve 40 is opened, again, secondary air is sucked into the exhaust manifold 4 by the exhaust pulsation effect. Again, the sizes of the various apertures and passages in this system are so tailored that, when the internal combustion engine 1 is idling and the secondary air control valve 40 is open, the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric.

The details of the internal construction of the secondary air control valve 40 are exactly the same as those of the secondary air control valve 40 shown with regard to the description of the first preferred embodiment of the air/fuel ratio control system according to the present invention, and hence explanation thereof is omitted here in order to avoid redundancy of description. Now the arrangements for providing actuating vacuum for the diaphragm device 45 of the secondary air control valve 40, which are substantially the same as in the second preferred embodiment, will be described.

As before, two vacuum take out ports 48 and 49 are provided in the throat 7 of the carburetor 2, near the trailing edge of the throttle valve 10. The first vacuum take out port 48 is so located that it is downstream of the throttle valve 10 when the throttle valve 10 is in its first idling position, and becomes to be upstream of the throttle valve 10 when the throttle valve 10 is opened slightly beyond its first idling position. On the other hand, the second vacuum take out port 49 is so located that it is downstream of the throttle valve 10 when the throttle valve 10 is in its second idling position or idle up position, and becomes to be upstream of the throttle valve 10 when the throttle valve 10 is opened slightly beyond its second idling or idle up position. Thus, in fact, the second vacuum take out port 49 is located very close to, but a little downstream of, the first vacuum take out port 48, in a fashion identical to that of the first preferred embodiment.

The first vacuum take out port 48 is connected via a conduit 64 to a port c of an electromagnetic vacuum switching valve 65. The second vacuum take out port 49 is connected via a conduit 66 to another port a of said electromagnetic vacuum switching valve 65. And the port b of the electromagnetic vacuum switching valve 65 is communicated directly, via a conduit 67, to the diaphragm chamber 46 of the diaphragm device 45 of the secondary air control valve 40.

The communications between the ports a, b, and c of the electromagnetic vacuum switching valve 65 are as follows. When actuating electrical energy is not being supplied to the electromagnetic vacuum switching valve 65, then the port b thereof is communicated to the port c thereof, while the port a is not communicated to anything; and, on the other hand, when actuating electrical energy is being supplied to the electromagnetic vacuum switching valve 65, then the port b thereof is communicated to the port a thereof, while the port c is not communicated to anything.

Actuating electrical energy is selectively supplied both to the electromagnetic vacuum switching valve 65 and to the solenoid device 62, in parallel, by an idle up control device 59 of a sort identical to the one shown with regard to the first through third preferred embodiments of the present invention, which receives input signals from an air conditioner compressor switch 60 and/or from a power steering pump switch 61, or the like, which depending upon these input signals decides when idle up of the internal combustion engine 1 should be performed, and which when it so decides supplies actuating electrical energy both to the electromagnetic vacuum switching valve 65 and to the solenoid device 62.

Thus it will be seen that this fourth preferred embodiment of the air/fuel ratio control system according to the present invention is in fact a combination of the second and the third embodiments, because of the use of bleed air into the carburetor to weaken the primary air-fuel mixture, and because of the use of an electrical actuator (the solenoid device 62) for performing idle up of the carburetor 2.

Operation of the Fourth Preferred Embodiment Non Idle Up Operation

First, suppose that based upon the output signals from the air conditioner compressor switch 60 and/or the power steering pump switch 61, etc., the idle up control device 59 is deciding that no idle up action needs to be provided for the internal combustion engine 1, and accordingly the idle up control device 59 is not providing any actuating electrical energy for the solenoid device 62 or for the electromagnetic switching valve 65. In this condition, the port b of the electromagnetic switching valve 65 is communicated to the port c thereof, while the port a is not communicated to anything, and therefore in this non idle up condition any vacuum which is present at the first vacuum take out port 48 is transmitted, via the electromagnetic switching valve 65, to the diaphragm chamber 46 of the diaphragm device 45 of the secondary air control valve 40. Further, no actuating electrical energy is provided to the solenoid device 62 by the idle up control device 59, and thus the rod 32 is not displaced by said solenoid device 62 in the upwards direction as seen in FIG. 4, and therefore no idle up effect is provided for the throttle valve 10, as explained above; in other words, the maximum closed position of the throttle valve 10 in this condition is its so called first idling position as shown by solid lines in FIG. 4, wherein the first vacuum take out port 48 is downstream of said throttle valve 10.

First, let us consider the case of idling operation at this non idle up time, when the throttle valve 10 is in its so called first idling position as shown by solid lines in FIG. 4. As in the case of the carburetor to which the first preferred embodiment was applied, the carburetor 2 of this fourth preferred embodiment is designed to deliver a basically richer mixture than stoichiometric (when no auxiliary bleed air is being supplied to the auxiliary bleed air pipe 71), and hence, since as will be seen hereinafter at this time in fact no injection of auxiliary weakening air is being provided through the auxiliary air bleed pipe 71 by the auxiliary air supply device 69, the internal combustion engine 1 is running with a somewhat rich idling mixture, which is effective for preventing stumbling, misfiring, and stalling. Because the throttle valve 10 is in its so called first idling position as shown by solid lines in FIG. 4, the first vacuum take out port 48 is downstream of said throttle valve 10, and therefore substantial vacuum is present at said first vacuum take out port 48. This vacuum is transmitted, via the conduit 64, the electromagnetic switching valve 65, and via the conduit 67, to the diaphragm chamber 46 of the secondary air control valve 40. Thereby, the diaphragm of the secondary air control valve 40, and the valve rod 44 attached thereto and the valve element 43, are displaced upwards as seen in the figure, and the valve element 43 is displaced away from the valve port 42, thus opening the valve port 42 and thereby communicating the secondary air injection port 38 with the atmosphere, via the one way reed valve 41, the secondary air control valve 40 which is open, and the air intake device 39. Thereby, as explained previously, due to the exhaust pulsation effect, secondary air is sucked into the exhaust manifold 4 through the intake device 39, the secondary air control valve 40, the one way reed valve 41, and the secondary air injection port 38.

As in the case of the first preferred embodiment, the sizes of the various apertures and passages in this system are so tailored that at this time the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric. Therefore, the oxygen sensor 37 will continuously detect presence of oxygen in the exhaust gases within the exhaust manifold 4, and will continuously dispatch a signal representative thereof to the auxiliary air control device 70, which will therefore continuously supply such a signal to the auxiliary air supply device 69 as to cause it not to feed any auxiliary air into the intake system of the internal combustion engine 1 via the auxiliary air bleed tube 71, as mentioned before. During this operational condition, the excess air ratio of the exhaust gases within the exhaust manifold 4 and being fed into the three way catalytic converter 6 through the exhaust tube 5 is substantially over unity—in other words, the exhaust gases have surplus oxygen in them—and therefore the three way catalytic converter 6 is being operated substantially only as an oxidizing catalytic converter, eliminating HC and CO and other products of incomplete combustion in the exhaust gases of the internal combustion engine 1 by an oxidizing reaction, but not substantially operating in the reduction mode to eliminate NOx from the exhaust gases; however, since in this rich idling operational condition of the internal combustion engine 1 the production of NOx is quite low and is not a significant problem in practice, this will be quite acceptable.

Now, suppose that from this non idle up idling condition, wherein the throttle valve 10 is in its first idling position, the throttle valve 10 is opened up to a substantial degree and is maintained in this state for power delivery operation of the internal combustion engine 1. As soon as the throttle valve 10 is opened up, the high degree of inlet manifold vacuum present at the first vacuum take out port 48 drops to substantially zero. Very quickly this substantially atmospheric pressure is transmitted along the conduit 64, past the electromagnetic switching valve 65, and along the conduit 67 to the diaphragm chamber 46 of the secondary air control valve 40. Thereby, the diaphragm of the secondary air control valve 40, and the valve rod 44 attached thereto and the valve element 43, are displaced downwards as seen in the figure due to the biasing effect of the compression coil spring 47, and the valve element 43 is displaced towards and against the valve port 42, thus closing the valve port 42 and thereby breaking the communication of the secondary air injection port 38 with the atmosphere via the one way reed valve 41, the secondary air control valve 40, and the air intake device 39. Thereby the flow of secondary air into the exhaust manifold 4 through the intake device 39, the secondary air control valve 40, the one way reed valve 41, and the secondary air injection port 38 immediately ceases, and does not recommence while the internal combustion engine 1 is in the non idling operational condition.

In this condition, since the basic air-fuel mixture provided by the carburetor 2, in this power operating condition as well as in the idling operational condition, as explained above, is somewhat richer than stoichiometric, the internal combustion engine 1 will initially be running on a richer than stoichiometric mixture. However, as in the first through third preferred embodiments shown in FIGS. 1 through 3 and described above, very quickly this will result in the excess oxygen present in the exhaust gases within the exhaust manifold 4 disappearing, and therefore the oxygen sensor 37 will cease to dispatch a signal representative of the presence of oxygen, and will start to dispatch a signal representative of absence of oxygen, to the auxiliary air control device 70. This auxiliary air control device 70 will therefore start to supply such a signal to the auxiliary air supply device 69 as to cause it to feed auxiliary air into the intake system of the internal combustion engine 1 through the auxiliary air bleed tube 71, and this will weaken the air/fuel ratio of the air-fuel mixture being supplied to the internal combustion engine 1. In a per se well known manner, by feedback control of the auxiliary air supply device 69 performed by the auxiliary air control device 70, therefore, the air/fuel ratio of the air-fuel mixture provided to the internal combustion engine 1 is brought to be on average substantially the stoichiometric value, by addition of the proper amount of auxiliary air thereto through the auxiliary air bleed tube 71. When this substantially stoichiometric air/fuel ratio for the intake air-fuel mixture of the internal combustion engine 1 has been attained, then the excess ratio of the exhaust gases in the exhaust manifold 4 and passed through the three way catalytic converter 6 will be approximately 1—i.e., these exhaust gases will be near the stoichiometric condition—and therefore the three way catalytic converter 6 will function properly and effectively in its three way catalytic mode of removing not only HC, CO, and other products of incomplete combustion from the exhaust gases by an oxidising reaction, but also of purifying the exhaust gases of NOx by a reducing reaction.

Thus, as has been explained above, in the case of non idle up operation, the transition between the idling mode of operation, wherein the internal combustion engine 1 is operated with an idling air-fuel mixture substantially richer than stoichiometric and the three way catalytic converter 6 is operated substantially only in its oxidizing mode of operation and no auxiliary air is supplied through the auxiliary air bleed tube 71 while secondary air is supplied through the secondary air injection port 38, and the non idling mode of operation, wherein the internal combustion engine 1 is operated with an air-fuel mixture substantially stoichiometric and the three way catalytic converter 6 is operated in both its oxidizing mode of operation and its reducing mode of operation and auxiliary air is supplied through the auxiliary air bleed tube 71 while no secondary air is supplied through the secondary air injection port 38, is performed quickly, reliably, and simply, according to the function of the shown fourth preferred embodiment of the air/fuel ratio control system according to the present invention, as well as according to the function of the previously shown first through third embodiments.

IDLE UP OPERATION

Now, on the other hand, suppose that based upon the output signals from the air conditioner compressor switch 60 and/or the power steering pump switch 61, etc., the idle up control device 59 is deciding that idle up action needs to be provided for the internal combustion engine 1, and accordingly the idle up control device 59 is providing actuating electrical energy for the electromagnetic switching valve 65 and for the solenoid device 62. In this condition, the port a of the electromagnetic switching valve 65 is communicated to the port b thereof, while the port c is not communicated to anything. Therefore in this idle up condition any vacuum which is present at the second vacuum take out port 49 is transmitted via the conduit 66, the electromagnetic switching valve 65, and the conduit 67 to the diaphragm chamber 46 of the diaphragm device 45 of the secondary air control valve 40. Further, actuating electrical energy is provided to the solenoid device 62 by the idle up control device 59, and thus the rod 32 is displaced by said solenoid device 62 in the upwards direction as seen in FIG. 4, and therefore an idle up effect is provided for the throttle valve 10, as explained previously; in other words, the maximum closed position of the throttle valve 10 in this condition is its so called second idling or idle up position as shown by the phantom lines in FIG. 4, wherein the first vacuum take out port 48 is in fact upstream of said throttle valve 10, but the second vacuum take out port 49 is just downstream of said throttle valve 10. Further, in this idle up condition any vacuum which is present at the second vacuum take out port 49 is transmitted, via the conduit 66, the electromagnetic switching valve 65, and the conduit 67, to the diaphragm chamber 46 of the diaphragm device 45 of the secondary air control valve 40.

First, let us consider the case of idling operation at this idle up time, when the throttle valve 10 is in its so called second idling position as shown by the phantom lines in FIG. 4. As has been previously mentioned, the carburetor 2 is designed to deliver a basically richer mixture than stoichiometric, and hence, since as will be seen hereinafter at this time no injection of auxiliary weakening air is being provided through the auxiliary air bleed tube 71 by the auxiliary air supply device 69, the internal combustion engine 1 is running with a somewhat rich idling mixture, which is effective for preventing stumbling, misfiring, and stalling. Because the throttle valve 10 is in its so called second idling position as shown by phantom lines in FIG. 4, the second vacuum take out port 49 is downstream of said throttle valve 10, and therefore substantial vacuum is present at said second vacuum take out port 49. This vacuum is transmitted, via the conduit 66, the electromagnetic switching valve 65 whose ports a and b are as stated above communicated to one another at this time, and via the conduit 67, to the diaphragm chamber 46 of the secondary air control valve 40. Thereby, the diaphragm of the secondary air control valve 40, and the valve rod 44 attached thereto and the valve element 43, are displaced upwards as seen in the figure, and the valve element 43 is displaced away from the valve port 42, thus opening the valve port 42 and thereby communicating the secondary air injection port 38 with the atmosphere, via the one way reed valve 41, the secondary air control valve 40 which is open, and the air intake device 39. Thereby, as explained previously, due to the exhaust pulsation effect, secondary air is sucked into the exhaust manifold 4 through the intake device 39, the secondary air control valve 40, the one way reed valve 41, and the secondary air injection port 38.

As has also been previously stated, the sizes of the various apertures and passages in this system are so tailored that at this time the supply rate of secondary air to the exhaust manifold 4 through the secondary air injection port 38 is sufficient to bring the excess air ratio of the exhaust gases to substantially over unity; in other words, so that the exhaust gases are substantially leaner than stoichiometric. Therefore, the oxygen sensor 37 will continuously detect presence of oxygen in the exhaust gases within the exhaust manifold 4, and will continuously dispatch a signal representative thereof to the auxiliary air control device 70, which will therefore continuously supply such a signal to the auxiliary air supply device 69 as to cause it not to feed any auxiliary air into the intake system of the internal combustion engine 1 through the auxiliary air bleed tube 71, as mentioned above. Further, during this operational condition, the excess air ratio of the exhaust gases within the exhaust manifold 4 and being fed into the three way catalytic converter 6 through the exhaust tube 5 is substantially over unity—in other words, the exhaust gases have surplus oxygen in them—and therefore the three way catalytic converter 6 is being operated substantially only as an oxidizing catalytic converter, eliminating HC and CO and other products of incomplete combustion in the exhaust gases of the internal combustion engine 1 by an oxidizing reaction, but not substantially operating in the reduction mode to eliminate NOx from the exhaust gases; however, since in this rich idle up idling operational condition of the internal combustion engine 1 the production of NOx is quite low and is not a significant problem in practice, this will be quite acceptable.

Now, suppose that from this idle up idling condition, wherein the throttle valve 10 is in its second or idle up idling position, the throttle valve 10 is opened up to a substantial degree and is maintained in this state for power delivery operation of the internal combustion engine 1. As soon as the throttle valve 10 is opened up, the high degree of inlet manifold vacuum present at the second vacuum take out port 49 drops to substantially zero. Very quickly this substantially atmospheric pressure is transmitted via the conduit 66, the electromagnetic switching valve 65, and the conduit 67 to the diaphragm chamber 46 of the secondary air control valve 40. Thereby, the diaphragm of the secondary air control valve 40, and the valve rod 44 attached thereto and the valve element 43, are displaced downwards as seen in the figure due to the biasing effect of the compression coil spring 47, and the valve element 43 is displaced towards and against the valve port 42, thus closing the valve port 42 and thereby breaking the communication of the secondary air injection port 38 with the atmosphere via the one way reed valve 41, the secondary air control valve 40, and the air intake device 39. Thereby the flow of secondary air into the exhaust manifold 4 through the intake device 39, the secondary air control valve 40, the one way reed valve 41, and the secondary air injection port 38 immediately ceases, and does not recommence while the internal combustion engine 1 is in the non idling operational condition.

In this condition, since the basic air-fuel mixture provided by the carburetor 2, in this power operating condition as well as in the idle up idling operational condition, as explained above, is somewhat richer than stoichiometric, the internal combustion engine 1 will initially be running on a richer than stoichiometric mixture. However, very quickly this will result in the excess oxygen present in the exhaust gases within the exhaust manifold 4 disappearing, and therefore the oxygen sensor 37 will cease to dispatch a signal representative of the presence of oxygen, and will start to dispatch a signal representative of absence of oxygen, to the auxiliary air control device 70. This auxiliary air control device 70 will therefore start to supply such a signal to the auxiliary air supply device 69 as to cause it to feed auxiliary air into the intake system of the internal combustion engine 1 through the auxiliary air bleed tube 71, and this will weaken the air/fuel ratio of the air-fuel mixture being supplied to the internal combustion engine 1. In a per se well known manner, by feedback control of the auxiliary air supply device 69 performed by the auxiliary air control device 70, therefore, the air/fuel ratio of the air-fuel mixture provided to the internal combustion engine 1 is brought to be substantially the stoichiometric value, by addition of the proper amount of auxiliary air thereto through the auxiliary air bleed tube 71. When this substantially stoichiometric air/fuel ratio for the intake gases of the internal combustion engine 1 has been attained, then the excess air ratio of the exhaust gases in the exhaust manifold 4 and passed through the three way catalytic converter 6 will be approximately 1—i.e., these exhaust gases will be near the stoichiometric condition—and therefore the three way catalytic converter 6 will function properly and effectively in its three way catalytic mode of removing not only HC, CO, and other products of incomplete combustion from the exhaust gases by an oxidising reaction, but also of purifying the exhaust gases of NOx by a reducing reaction.

Thus, as has been explained above, in the case of idle up operation, the transition between the idle up idling mode of operation, wherein the internal combustion engine 1 is operated with an idle up idling air-fuel mixture substantially richer than stoichiometric and the three way catalytic converter 6 is operated substantially only in its oxidizing mode of operation and no auxiliary air is supplied through the auxiliary air bleed tube 71 while secondary air is supplied through the secondary air injection port 38, and the non idling mode of operation, wherein the internal combustion engine 1 is operated with an air-fuel mixture substantially stoichiometric and the three way catalytic converter 6 is operated in both its oxidizing mode of operation and its reducing mode of operation and auxiliary air is supplied through the auxiliary air bleed tube 71 while no secondary air is supplied through the secondary air injection port 38, is performed quickly, reliably, and simply, according to the function of the shown fourth preferred embodiment of the air/fuel ratio control system according to the present invention.

In summary, as will be clear from the above, in the operation of the shown fourth preferred embodiment of the air/fuel ratio control system according to the present invention, as well as in the function of the first through third preferred embodiments, in both the non idle up mode of operation thereof, and the idle up mode of operation thereof: when the throttle valve 10 is in its idling position (respectively either non idle up idling position or the idle up idling position) then the internal combustion engine 1 is operated with an air-fuel mixture with an air/fuel ratio which is substantially richer than the stoichiometric one, which is effective for preventing stumbling, misfiring, and stalling of said internal combustion engine 1 during idling; while, on the other hand, when the throttle valve 10 is moved away from its idling position (whichever of the above non idle up or idle up idling positions said idling position may respectively currently be) by even a small amount, then the internal combustion engine 1 is operated with an air-fuel mixture with an air/fuel ratio which is substantially stoichiometric, which is effective for promoting proper operation of the three way catalytic converter 6 in its three way operational mode.

Although the present invention has been shown and described with reference to several preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiments, or of the drawings, but solely by the scope of the appended claims, which follow.

What is claimed is:

1. For an internal combustion engine comprising an exhaust system and a fuel intake passage system comprising a carburetor which comprises an intake throat, a throttle valve mounted in said intake throat, and an idle up device which selectively acts on said throttle valve so as to control its most closed position to be either a first idling position near its fully closed position or a second idle up idling position slightly more open that said first idling position; said carburetor in its basic operational mode tending to deliver an air/fuel mixture richer than stoichiometric:

an air/fuel ratio control system, comprising:

(a) an oxygen sensor for detecting the concentration of oxygen in the exhaust gases in said exhaust system;

(b) a means for adjusting the air/fuel ratio of the air/fuel mixture being supplied to the engine through said fuel intake passage system towards the leaner, which receives the signal from said oxygen sensor, and which functions only when said sensor is detecting no oxygen in the exhaust gases in said exhaust system;

(c) a means for supplying a flow of secondary air into said exhaust system during idling engine operation, upstream of said oxygen sensor, in a flow amount sufficient to render the exhaust gases in said exhaust system leaner than stoichiometric, said means thus supplying secondary air when and only when it receives supply of a controlling vacuum;

(d) a first vacuum takeout port formed at a point in said intake throat which is downstream of said throttle valve when said throttle valve is in said first idling position but which is upstream of said throttle valve when said throttle valve is opened a slight amount from said first idling position;

(e) a second vacuum takeout port formed at a point in said intake throat which is downstream of said throttle valve when said throttle valve is in said second idle up idling position but which is upstream of said throttle valve when said throttle valve is opened a slight amount from said second idle up idling position; and (f) a vacuum switching system, which provides supply of vacuum from said first vacuum take out port to said means for supplying secondary air as said controlling vacuum when said idle up device is controlling the most closed position of said throttle valve to be said first idling position, and which provides supply of vacuum from said second vacuum take out port to said means for supplying secondary air as said controlling vacuum when said idle up device is controlling the most closed position of said throttle valve to be said second idle up idling position.

2. An air/fuel ratio control system according to claim 1, wherein said means for adjusting the air/fuel ratio of the air/fuel mixture being supplied to the engine through said fuel intake passage system towards the leaner injects air into said intake passage system downstream of said carburetor.

3. An air/fuel ratio control system according to claim 2, for an internal combustion engine wherein said idle up device comprises a vacuum actuator which when supplied with vacuum moves a stop against which said throttle valve abuts in its idling position in the direction of increasing idling speed, and an electric control device which despatches an electrical signal when idle up is to be performed: wherein said vacuum switching system comprises an electromagnetic switching valve with a first, a second, and a third port, a one way valve, a vacuum conduit, and a throttling element; said second and said third ports of said electromagnetic switching valve being communicated together when said electromagnetic switching valve is not supplied with actuating electrical energy, and said first and said second ports of said electromagnetic switching valve being communicated together when said electromagnetic switching valve is supplied with actuating electrical energy; said electromagnetic switching valve being supplied with said electrical signal as supply of actuating electrical energy; said third port of said electromagnetic switching valve being communicated to atmosphere; said first port of said electromagnetic switching valve being communicated to said second vacuum take out port; and said second port of said electromagnetic switching valve being communicated to said vacuum actuator of said idle up device and also being communicated via said one way valve against its direction of transmitting fluid to a first end of said conduit, the other end of said conduit being communicated to said means for supplying a flow of secondary air into said exhaust system during idling engine operation so as to supply said controlling vacuum thereto; an intermediate part of said conduit also being communicated via said throttling element to said first vacuum take out port.

4. An air/fuel ratio control system according to claim 2, for an internal combustion engine wherein said idle up device comprises an electric actuator which when supplied with actuating electrical energy moves a stop against which said throttle valve abuts in its idling position in the direction of increasing idling speed, and an electric control device which despatches an electrical signal to said electric actuator when idle up is to be performed: wherein said vacuum switching system comprises an electromagnetic switching valve with a first, a second, and a third port; said second and said third ports of said electromagnetic switching valve being communicated together when said electromagnetic switching valve is not supplied with actuating electrical energy, and said first and said second ports of said electromagnetic switching valve being communicated together when said electromagnetic switching valve is supplied with actuating electrical energy; said electromagnetic switching valve being supplied with said electrical signal as supply of actuating electrical energy; said third port of said electromagnetic switching valve being communicated to said first vacuum take out port; said first port of said electromagnetic switching valve being communicated to said second vacuum take out port; and said second port of said electromagnetic switching valve being communicated to said means for supplying a flow of secondary air into said exhaust system during idling engine operation so as to supply said controlling vacuum thereto.

5. An air/fuel ratio control system according to claim 1, said carburetor being formed with an auxiliary air bleed passage, wherein said means for adjusting the air/fuel ratio of the air/fuel mixture being supplied to the engine through said fuel intake passage system towards the leaner injects air into said auxiliary air bleed passage.

6. An air/fuel ratio control system according to claim 5, for an internal combustion engine wherein said idle up device comprises a vacuum actuator which when supplied with vacuum moves a stop against which said throttle valve abuts in its idling position in the direction of increasing idling speed, and an electric control device which despatches an electrical signal when idle up is to be performed: wherein said vacuum switching system comprises an electromagnetic switching valve with a first, a second, and a third port, a one way valve, a vacuum conduit, and a throttling element; said second and said third ports of said electromagnetic switching valve being communicated together when said electromagnetic switching valve is not supplied with actuating electrical energy, and said first and said second ports of said electromagnetic switching valve being communicated together when said electromagnetic switching valve is supplied with actuating electrical energy; said electromagnetic switching valve being supplied with said electrical signal as supply of actuating electrical energy; said third port of said electromagnetic switching valve being communicated to atmosphere; said first port of said electromagnetic switching valve being communicated to said second vacuum take out port; and said second port of said electromagnetic switching valve being communicated to said vacuum actuator of said idle up device and also being communicated via said one way valve against its direction of transmitting fluid to a first end of said conduit, the other end of said conduit being communicated to said means for supplying a flow of secondary air into said exhaust system during idling engine operation so as to supply said controlling vacuum thereto; an intermediate part of said conduit also being communicated via said throttling element to said first vacuum take out port.

7. An air/fuel ratio control system according to claim 5, for an internal combustion engine wherein said idle up device comprises an electric actuator which when supplied with actuating electrical energy moves a stop against which said throttle valve abuts in its idling position in the direction of increasing idling speed, and an electric control device which despatches an electrical signal to said electric actuator when idle up is to be performed: wherein said vacuum switching system comprises an electromagnetic switching valve with a first, a second, and a third port; said second and said third ports of said electromagnetic switching valve being communicated together when said electromagnetic switching valve is not supplied with actuating electrical energy, and said first and said second ports of said electromagnetic switching valve being communicated together when said electromagnetic switching valve is supplied with actuating electrical energy; said electromagnetic switching valve being supplied with said electrical signal as supply of actuating electrical energy; said third port of said electromagnetic switching valve being communicated to said first vacuum take out port; said first port of said electromagnetic switching valve being communicated to said second vacuum take out port; and said second port of said electromagnetic switching valve being communicated to said means for supplying a flow of secondary air into said exhaust system during idling engine operation so as to supply said controlling vacuum thereto.

8. An air/fuel ratio control system according to any one of the previous claims, wherein said means for supplying a flow of secondary air into said exhaust system comprises a vacuum actuated valve which controls flow of atmospheric air into a port formed in said exhaust system.

9. An air/fuel ratio control system according to claim 8, wherein said vacuum actuated valve comprises a valve port, a valve element, and a vacuum actuator, said controlling vacuum being supplied to said vacuum actuator, and said valve element being drivingly coupled to said vacuum actuator so as to be selectively driven against said valve port or withdrawn from said valve port, according respectively as said controlling vacuum is not present, or is present.

10. An air/fuel ratio control system according to claim 9, wherein said means for supplying a flow of secondary air into said exhaust system further comprises a one way air valve in series with said vacuum actuated valve, said one way valve only allowing flow of air into said exhaust system, and not in the reverse direction.

11. An air/fuel ratio control system according to claim 10, wherein said one way air valve is a reed valve.

12. An air/fuel ratio control system according to claim 8, wherein said means for supplying a flow of secondary air into said exhaust system further comprises a one way air valve in series with said vacuum actuated valve, said one way valve only allowing flow of air into said exhaust system, and not in the reverse direction.

13. An air/fuel ratio control system according to claim 12, wherein said one way air valve is a reed valve.

* * * * *